US009197977B2

(12) United States Patent
Mahabub et al.

(10) Patent No.: US 9,197,977 B2
(45) Date of Patent: Nov. 24, 2015

(54) AUDIO SPATIALIZATION AND ENVIRONMENT SIMULATION

(75) Inventors: Jerry Mahabub, Littleton, CO (US); Stephan M. Bernsee, Mainz (DE); Gary Smith, Castle Rock, CO (US)

(73) Assignee: GenAudio, Inc., Centennial, CO (US)

( * ) Notice: Subject to any disclaimer, the term of this patent is extended or adjusted under 35 U.S.C. 154(b) by 1204 days.

(21) Appl. No.: 12/041,191

(22) Filed: Mar. 3, 2008

(65) Prior Publication Data

US 2009/0046864 A1 Feb. 19, 2009

Related U.S. Application Data

(60) Provisional application No. 60/892,508, filed on Mar. 1, 2007.

(51) Int. Cl.
*H04R 5/00* (2006.01)
*H04S 7/00* (2006.01)
(Continued)

(52) U.S. Cl.
CPC . *H04S 7/30* (2013.01); *H04R 5/033* (2013.01); *H04R 5/04* (2013.01); *H04S 7/305* (2013.01); *H04S 2400/11* (2013.01); *H04S 2420/01* (2013.01)

(58) Field of Classification Search
CPC .... H04R 1/1041; H04R 1/1061; H04R 3/005; H04R 5/04; H04R 5/033; H04R 5/027; H04R 2420/07; H04S 1/00; H04S 1/002; H04S 1/005; H04S 3/00; H04S 2400/01; H04S 2420/01; H04S 7/30; H04S 7/301; H04S 7/302; H04S 7/303; H04S 7/304; H04S 7/305; H04S 7/306; H04S 7/307; H04S 7/308; H04S 2400/11; H04S 3/004
USPC ..... 381/1–23, 300–311, 92, 98–103, 26, 74
See application file for complete search history.

(56) References Cited

U.S. PATENT DOCUMENTS 5,500,900 A 3/1996 Chen et al.
5,521,981 A * 5/1996 Gehring ..... 381/17
(Continued)

FOREIGN PATENT DOCUMENTS

JP 7-248255 A 9/1995
JP 7-288900 10/1995
(Continued)

OTHER PUBLICATIONS

International Search Report, Application No. PCT/US08/55669, 5 pages, Jul. 25, 2008.
(Continued)

*Primary Examiner* — Xu Mei
(74) *Attorney, Agent, or Firm* — Polsinelli PC

(57) ABSTRACT

A method and apparatus for processing an audio sound source to create four-dimensional spatialized sound. A virtual sound source may be moved along a path in three-dimensional space over a specified time period to achieve four-dimensional sound localization. A binaural filter for a desired spatial point is applied to the audio waveform to yield a spatialized waveform that, when the spatialized waveform is played from a pair of speakers, the sound appears to emanate from the chosen spatial point instead of the speakers. A binaural filter for a spatial point is simulated by interpolating nearest neighbor binaural filters chosen from a plurality of pre-defined binaural filters. The audio waveform may be processed digitally in overlapping blocks of data using a Short-Time Fourier transform. The localized sound may be further processed for Doppler shift and room simulation.

13 Claims, 24 Drawing Sheets

(51) Int. Cl.
*H04R 5/033* (2006.01)
*H04R 5/04* (2006.01)

(56) References Cited

U.S. PATENT DOCUMENTS

| | | | | |
|---|---|---|---|---|
| 5,622,172 | A * | 4/1997 | Li et al. | 600/443 |
| 5,729,612 | A * | 3/1998 | Abel et al. | 381/56 |
| 5,751,817 | A | 5/1998 | Brungart | |
| 5,802,180 | A | 9/1998 | Abel et al. | |
| 5,943,427 | A | 8/1999 | Massie et al. | |
| 6,072,877 | A * | 6/2000 | Abel | 381/17 |
| 6,118,875 | A | 9/2000 | Moller et al. | |
| 6,243,476 | B1 * | 6/2001 | Gardner | 381/303 |
| 6,421,446 | B1 | 7/2002 | Cashion et al. | |
| 6,466,913 | B1 | 10/2002 | Yasusa et al. | |
| 6,498,856 | B1 | 12/2002 | Itabashi et al. | |
| 6,990,205 | B1 | 1/2006 | Chen | |
| 7,174,229 | B1 * | 2/2007 | Chen et al. | 700/94 |
| 2004/0196994 | A1 | 10/2004 | Kates | |
| 2004/0247144 | A1 | 12/2004 | Nelson et al. | |
| 2005/0180579 | A1 | 8/2005 | Baumgarte et al. | |
| 2005/0195995 | A1 | 9/2005 | Baumgarte | |
| 2007/0030982 | A1 | 2/2007 | Jones et al. | |
| 2007/0160219 | A1 * | 7/2007 | Jakka et al. | 381/22 |

FOREIGN PATENT DOCUMENTS

| | | | |
|---|---|---|---|
| JP | 2000-023299 | | 1/2000 |
| JP | 2000-261899 | | 9/2000 |
| WO | WO 95/23493 | A1 | 8/1995 |
| WO | 2005089360 | A2 | 9/2005 |
| WO | WO 2005/089360 | | 9/2005 |
| WO | 2006090589 | A1 | 8/2006 |

OTHER PUBLICATIONS

Author Unknown, "1999 IEEE Workshop on Applications of Signal Processing Audio and Acoustics", http://www.acoustics.hut.fi/waspaa99/program/accepted.html, Jul. 13, 1999.

Author Unknown, "Cape Arago Lighthouse Pt. Foghorns, Birds, Wind, and Waves", http://www.sonicstudios.com/foghorn.htm, 5 pages, at least as early as Oct. 28, 2004.

Author Unknown, "EveryMac.com", Apple Power Macintosh G5 2.0 DP(PCI-X) Specs (M9032LL/A), 6 pages, 2003.

Author Unknown, "General Solution of the Wave Equation", www.silcom.com/~aludwig/Physics/Gensol/General_solution.html, 10 pages, Dec. 2002.

Author Unknown, "The FlReverb Suite™ audio demonstration", http://www.catt.se/suite_music/, 5 pages, 2000-2001.

Author Unknown, "Vivid Curve Loon Lake CD Recording Session", http://www.sonicstudios.com/vcloonlk.htm, 10 pages, 1999.

Author Unknown, "Wave Field Synthesis: A brief overview", http://recherche.ircam.fr/equipes/salles/WFS_WEBSITE/Index_wfs_site.htm, 5 pages, at least as early as Oct. 28, 2004.

Author Unknown, "Wave Surround—Essential tools for sound processing", http://www.wavearts.com/WaveSurroundPro.html, 3 pages, 2004.

Gardner et al., "HRTF Measurements of a KEMAR Dummy-Head Microphone", MIT Media Lab-Technical Report #280, pp. 1-6, May 1994.

Glasgal, Ralph, "Ambiophonics—Ambiofiles : Now you can have 360° PanAmbio surround", http://www.ambiophonics.org/Ambiofiles.htm, 3 pages, at least as early as Oct. 28, 2004.

Glasgal, Ralph, "Ambiophonics—Testimonials", http://www.ambiophonics.org/testimonials.htm, 3 pages, at least as early as Oct. 28, 2004.

Li et al., "Recording and Rendering of Auditory Scenes through HRTF", University of Maryland, Perceptual Interfaces and Reality Lab and Neural Systems Lab, 1 page, at least as early as Oct. 28, 2004.

Miller III, Robert E., "Audio Engineering Society: Convention Paper", Presented at the 112th Conventsion, Munich, Germany, 12 pages, May 10-13, 2002.

Tronchin et al., "The Calculation of the Impulse Response in the Binaural Technique", Dienca-Ciarm, University of Bologna, Bologna, Italy, 8 pages, at least as early as Oct. 28, 2004.

Zotkin et al., "Rendering Localized Spatial Audio in a Virtual Auditory Space", Perceptual Interfaces and Reality Laboratory, Institute for Advanced Computer Studies, University of Maryland, College Park, Maryland, USA, 29 pages, 2002.

EP Application No. 08731259.1.

Search Report dated Mar. 23, 2012, EP Application No. 08731259.1, 11 pages.

JP Application No. 2009-551888.

First Office Action of Jul. 29, 2011, JP Application No. 2009-551888, 5 pages.

Final Office Action dated Apr. 2, 2012, JP Application No. 2009-551888, 5 pages.

Japanese Office Action (with translation) dated Jun. 6, 2014 for Application No. 2013-115628, 8 pages.

First Office Action from Chinese Patent Office (with English Translation) dated May 4, 2015 for Chinese Application No. 201310399656.

* cited by examiner

AUDIO SPATIALIZATION AND ENVIRONMENT SIMULATION

CROSS-REFERENCE TO RELATED APPLICATIONS

This application claims the benefit of U.S. Provisional Application No. 60/892,508, filed Mar. 1, 2007 and entitled "Audio Spatialization and Environment Simulation," the disclosure of which is hereby incorporated herein in its entirety.

BACKGROUND OF THE INVENTION

1. Technical Field

This invention relates generally to sound engineering, and more specifically to digital signal processing methods and apparatuses for calculating and creating an audio waveform, which, when played through headphones, speakers, or another playback device, emulates at least one sound emanating from at least one spatial coordinate in four-dimensional space 2. Background Art Sounds emanate from various points in four-dimensional space. Humans hearing these sounds may employ a variety of aural cues to determine the spatial point from which the sounds originate. For example, the human brain quickly and effectively processes sound localization cues such as inter-aural time delays (i.e., the delay in time between a sound impacting each eardrum), sound pressure level differences between a listener's ears, phase shifts in the perception of a sound impacting the left and right ears, and so on to accurately identify the sound's origination point. Generally, "sound localization cues" refers to time and/or level differences between a listener's ears, time and/or level differences in the sound waves, as well as spectral information for an audio waveform. ("Four-dimensional space," as used herein, generally refers to a three-dimensional space across time, or a three-dimensional coordinate displacement as a function of time, and/or parametrically defined curves. A four-dimensional space is typically defined using a 4-space coordinate or position vector, for example $\{x, y, z, t\}$ in a rectangular system, $\{r, \theta, \phi, t,\}$ in a spherical system, and so on.)

The effectiveness of the human brain and auditory system in triangulating a sound's origin presents special challenges to audio engineers and others attempting to replicate and spatialize sound for playback across two or more speakers. Generally, past approaches have employed sophisticated pre- and post-processing of sounds, and may require specialized hardware such as decoder boards or logic. Good examples of these approaches include Dolby Labs' DOLBY Digital processing, DTS, Sony's SDDS format, and so forth. While these approaches have achieved some degree of success, they are cost- and labor-intensive. Further, playback of processed audio typically requires relatively expensive audio components. Additionally, these approaches may not be suited for all types of audio, or all audio applications.

Accordingly, a novel approach to audio spatialization is required, that places the listener in the center of a virtual sphere (or simulated virtual environment of any shape or size) of stationary and moving sound sources to provide a true-to-life sound experience from as few as two speakers or headphones.

BRIEF SUMMARY OF THE INVENTION

Generally, one embodiment of the present invention takes the form of a method and apparatus for creating four-dimensional spatialized sound. In a broad aspect, an exemplary method for creating a spatialized sound by spatializing an audio waveform includes the operations of determining a spatial point in a spherical or Cartesian coordinate system, and applying an impulse response filter corresponding to the spatial point to a first segment of the audio waveform to yield a spatialized waveform. The spatialized waveform emulates the audio characteristics of the non-spatialized waveform emanating from the spatial point. That is, the phase, amplitude, inter-aural time delay, and so forth are such that, when the spatialized waveform is played from a pair of speakers, the sound appears to emanate from the chosen spatial point instead of the speakers.

A head-related transfer function is a model of acoustic properties for a given spatial point, taking into account various boundary conditions. In the present embodiment, the head-related transfer function is calculated in a spherical coordinate system for the given spatial point. By using spherical coordinates, a more precise transfer function (and thus a more precise impulse response filter) may be created. This, in turn, permits more accurate audio spatialization.

As can be appreciated, the present embodiment may employ multiple head-related transfer functions, and thus multiple impulse response filters, to spatialize audio for a variety of spatial points. (As used herein, the terms "spatial point" and "spatial coordinate" are interchangeable.) Thus, the present embodiment may cause an audio waveform to emulate a variety of acoustic characteristics, thus seemingly emanating from different spatial points at different times. In order to provide a smooth transition between two spatial points and therefore a smooth four-dimensional audio experience, various spatialized waveforms may be convolved with one another through an interpolation process.

It should be noted that no specialized hardware or additional software, such as decoder boards or applications, or stereo equipment employing DOLBY or DTS processing equipment, is required to achieve full spatialization of audio in the present embodiment. Rather, the spatialized audio waveforms may be played by any audio system having two or more speakers, with or without logic processing or decoding, and a full range of four-dimensional spatialization achieved.

These and other advantages and features of the present invention will be apparent upon reading the following description and claims.

DETAILED DESCRIPTION OF THE INVENTION

1. Overview of the Invention

Figure 1:
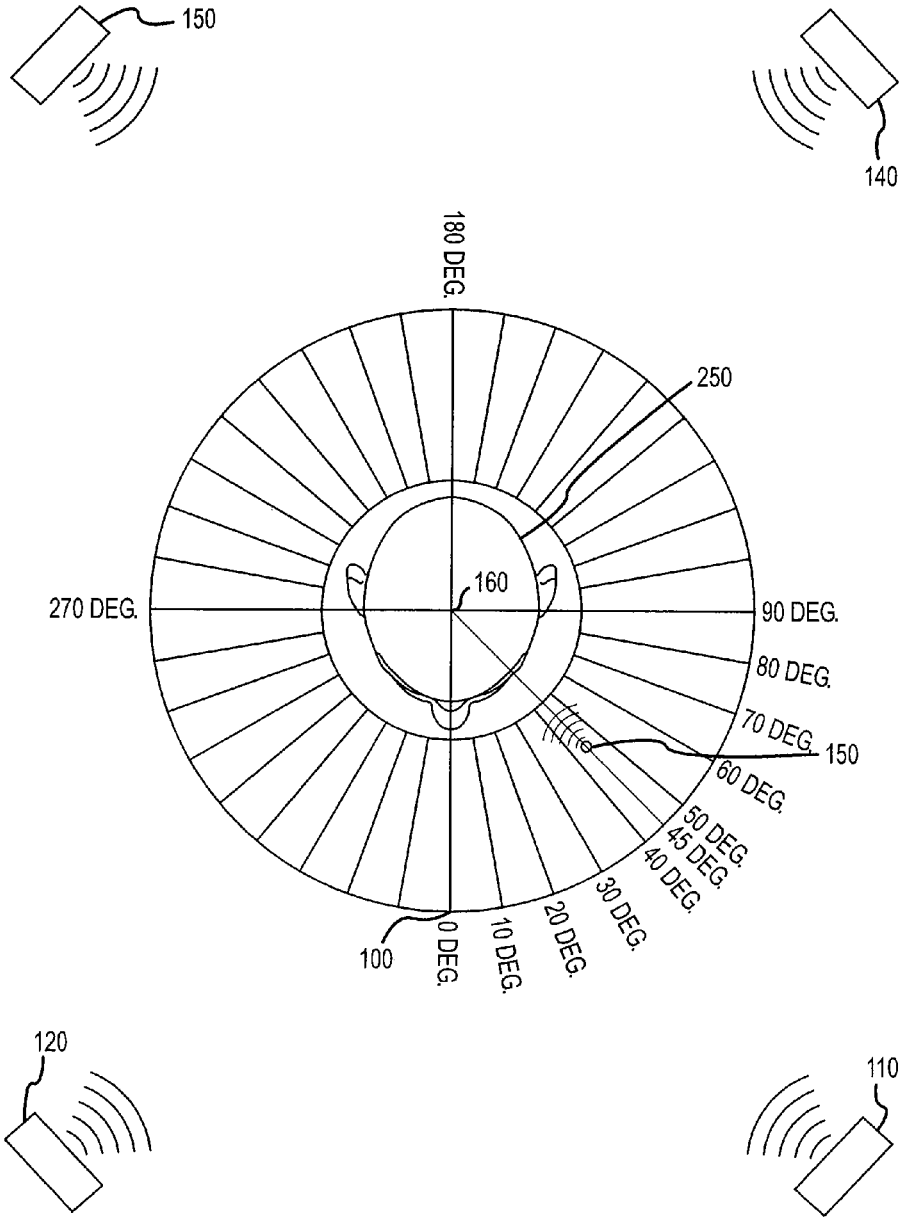
FIG. 1 depicts a top-down view of a listener occupying a "sweet spot" between four speakers, as well as an exemplary azimuthal coordinate system.

Generally, one embodiment of the present invention utilizes sound localization technology to place a listener in the center of a virtual sphere or virtual room of any size/shape of stationary and moving sound. This provides the listener with a true-to-life sound experience using as few as two speakers or a pair of headphones. The impression of a virtual sound source at an arbitrary position may be created by processing an audio signal to split it into a left and right ear channel, applying a separate filter to each of the two channels ("binaural filtering"), to create an output stream of processed audio that may be played back through speakers or headphones or stored in a file for later playback.

In one embodiment of the present invention audio sources are processed to achieve four-dimensional ("4D") sound localization. 4D processing allows a virtual sound source to be moved along a path in three-dimensional ("3D") space over a specified time period. When a spatialized waveform transitions between multiple spatial coordinates (typically to replicate a sound source "moving" in space), the transition between spatial coordinates may be smoothed to create a more realistic, accurate experience. In other words, the spatialized waveform may be manipulated to cause the spatialized sound to apparently smoothly transition from one spatial coordinate to another, rather than abruptly changing between discontinuous points in space (even though the spatialized sound is actually emanating from one or more speakers, a pair of headphones or other playback device). In other words, the spatialized sound corresponding to the spatialized waveform may seem not only to emanate from a point in 3D space other than the point(s) occupied by the playback device(s), but the apparent point of emanation may change over time. In the present embodiment, the spatialized waveform may be convolved from a first spatial coordinate to a second spatial coordinate, within a free field, independent of direction, and/or diffuse field binaural environment.

Three-dimensional sound localization (and, ultimately, 4D localization) may be achieved by filtering the input audio data with a set of filters derived from a pre-determined head-related transfer function ("HRTF") or head related impulse response ("HRIR"), which may mathematically model the variance in phase and amplitude over frequency for each ear for a sound emanating from a given 3D coordinate. That is, each three-dimensional coordinate may have a unique HRTF and/or HRIR. For spatial coordinates lacking a pre-calculated filter, HRTF or HRIR, an estimated filter, HRTF or HRIR may be interpolated from nearby filters/HRTFs/HRIRs. Interpolation is described in more detail below. Details on how the HRTF and/or HRIR is derived may be found in U.S. patent application Ser. No. 10/802,319, filed on Mar. 16, 2004, which is hereby incorporated by reference in its entirety.

The HRTF may take into account various physiological factors, such as reflections or echoes within the pinna of an ear or distortions caused by the pinna's irregular shape, sound reflection from a listener's shoulders and/or torso, distance between a listener's eardrums, and so forth. The HRTF may incorporate such factors to yield a more faithful or accurate reproduction of a spatialized sound.

An impulse response filter (generally finite, but infinite in alternate embodiments) may be created or calculated to emulate the spatial properties of the HRTF. In short, however, the impulse response filter is a numerical/digital representation of the HRTF.

A stereo waveform may be transformed by applying the impulse response filter, or an approximation thereof, through the present method to create a spatialized waveform. Each point (or every point separated by a time interval) on the stereo waveform is effectively mapped to a spatial coordinate from which the corresponding sound will emanate. The stereo waveform may be sampled and subjected to a finite impulse response filter ("FIR"), which approximates the aforementioned HRTF. For reference, a FIR is a type of digital signal filter, in which every output sample equals the weighted sum of past and current samples of input, using only some finite number of past samples.

The FIR, or its coefficients, generally modifies the waveform to replicate the spatialized sound. As the coefficients of a FIR are defined, they may be applied to additional dichotic waveforms (either stereo or mono) to spatialize sound for those waveforms, skipping the intermediate step of generating the FIR every time. Other embodiments of the present invention may approximate the HRTF using other types of impulse response filters such as infinite impulse response ("IIR") filters rather than FIR filters.

The present embodiment may replicate a sound at a point in three-dimensional space, with increasing precision as the size of the virtual environment decreases. One embodiment of the present invention measures an arbitrarily sized room as the virtual environment using relative units of measure, from zero to one hundred, from the center of the virtual room to its boundary. The present embodiment employs spherical coordinates to measure the location of the spatialization point within the virtual room. It should be noted that the spatialization point in question is relative to the listener. That is, the center of the listener's head corresponds to the origin point of the spherical coordinate system. Thus, the relative precision of replication given above is with respect to the room size and enhances the listener's perception of the spatialized point.

One exemplary embodiment of the present invention employs a set of 7337 pre-computed HRTF filter sets located on the unit sphere, with a left and a right HRTF filter in each filter set. As used herein, a "unit sphere" is a spherical coordinate system with azimuth and elevation measured in degrees. Other points in space may be simulated by appropriately interpolating the filter coefficients for that position, as described in greater detail below.

2. Spherical Coordinate Systems

Generally, the present embodiment employs a spherical coordinate system (i.e., a coordinate system having radius r, altitude $\theta$, and azimuth $\phi$ as coordinates), but allows for inputs in a standard Cartesian coordinate system. Cartesian inputs may be transformed to spherical coordinates by certain embodiments of the invention. The spherical coordinates may be used for mapping the simulated spatial point, calculation of the HRTF filter coefficients, convolution between two spatial points, and/or substantially all calculations described herein. Generally, by employing a spherical coordinate system, accuracy of the HRTF filters (and thus spatial accuracy of the waveform during playback) may be increased. Accordingly, certain advantages, such as increased accuracy and precision, may be achieved when various spatialization operations are carried out in a spherical coordinate system.

Additionally, in certain embodiments the use of spherical coordinates may minimize processing time required to create the HRTF filters and convolve spatial audio between spatial points, as well as other processing operations described herein. Since sound/audio waves generally travel through a medium as a spherical wave, spherical coordinate systems are well-suited to model sound wave behavior, and thus spatialize sound. Alternate embodiments may employ different coordinate systems, including a Cartesian coordinate system.

Figure 2:
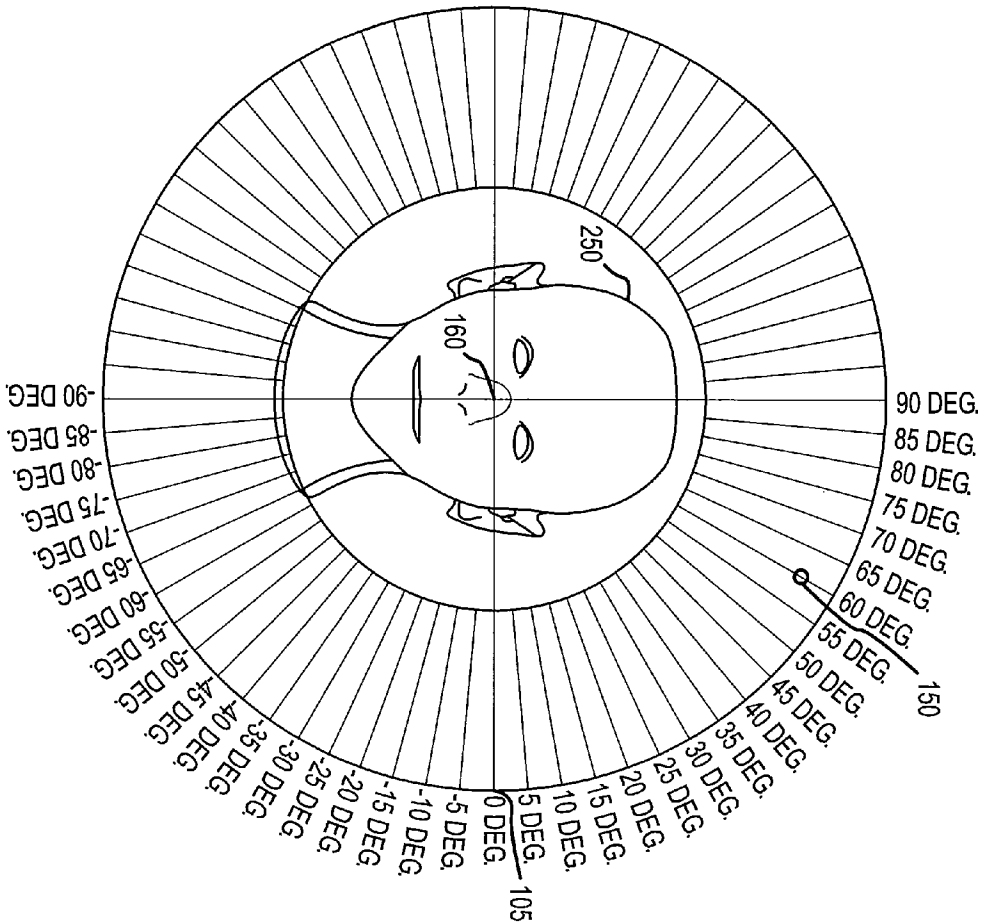
FIG. 2 depicts a front view of the listener shown in FIG. 1, as well as an exemplary altitudinal coordinate system.
Figure 3:
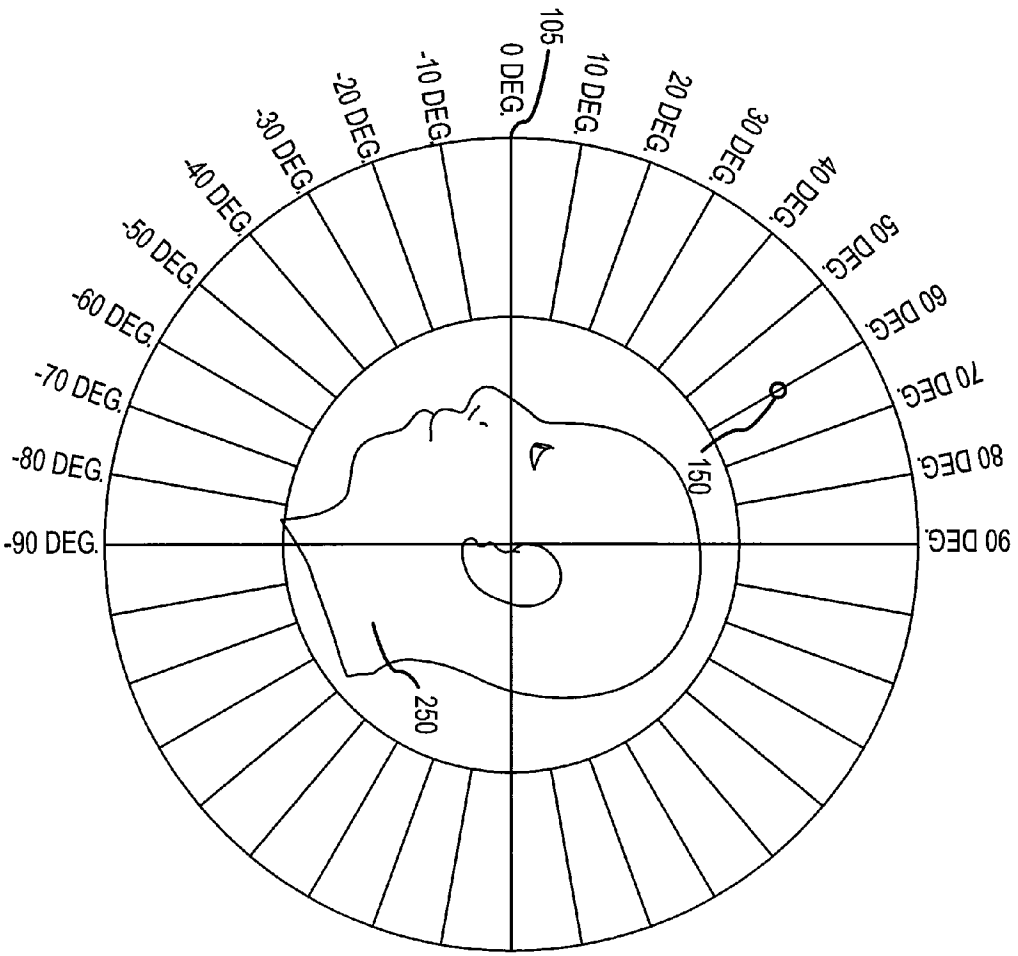
FIG. 3 depicts a side view of the listener shown in FIG. 1, as well as the exemplary altitudinal coordinate system of FIG. 2.

In the present document, a specific spherical coordinate convention is employed when discussing exemplary embodiments. Further, zero azimuth 100, zero altitude 105, and a non-zero radius of sufficient length correspond to a point in front of the center of a listener's head, as shown in FIGS. 1 and 3, respectively. As previously mentioned, the terms "altitude" and "elevation" are generally interchangeable herein. In the present embodiment, azimuth increases in a clockwise direction, with 180 degrees being directly behind the listener. Azimuth ranges from 0 to 359 degrees. An alternative embodiment may increase azimuth in a counter-clockwise direction as shown in FIG. 1. Similarly, altitude may range from 90 degrees (directly above a listener's head) to −90 degrees (directly below a listener's head), as shown in FIG. 2. FIG. 3 depicts a side view of the altitude coordinate system used herein.

It should be noted that in this document's discussion of the aforementioned coordinate system it is presumed a listener faces a main, or front, pair of speakers 110, 120. Thus, as shown in FIG. 1, the azimuthal hemisphere corresponding to the front speakers' emplacement ranges from 0 to 90 degrees and 270 to 359 degrees, while the azimuthal hemisphere corresponding to the rear speakers' emplacement ranges from 90 to 270 degrees. In the event the listener changes his rotational alignment with respect to the front speakers 110, 120, the coordinate system does not vary. In other words, azimuth and altitude are speaker dependent, and listener independent. However, the reference coordinate system is listener dependent when spatialized audio is played back across headphones worn by the listener, insofar as the headphones move with the listener. For purposes of the discussion herein, it is presumed the listener remains relatively centered between, and equidistant from, a pair of front speakers 110, 120. Rear, or additional ambient speakers 130, 140 are optional. The origin point 160 of the coordinate system corresponds approximately to the center of a listener's head 250, or the "sweet spot" in the speaker set up of FIG. 1. It should be noted, however, that any spherical coordinate notation may be employed with the present embodiment. The present notation is provided for convenience only, rather than as a limitation. Additionally, the spatialization of audio waveforms and corresponding spatialization effect when played back across speakers or another playback device do not necessarily depend on a listener occupying the "sweet spot" or any other position relative to the playback device(s). The spatialized waveform may be played back through standard audio playback apparatus to create the spatial illusion of the spatialized audio emanating from a virtual sound source location 150 during playback.

3. Software Architecture

Figure 4:
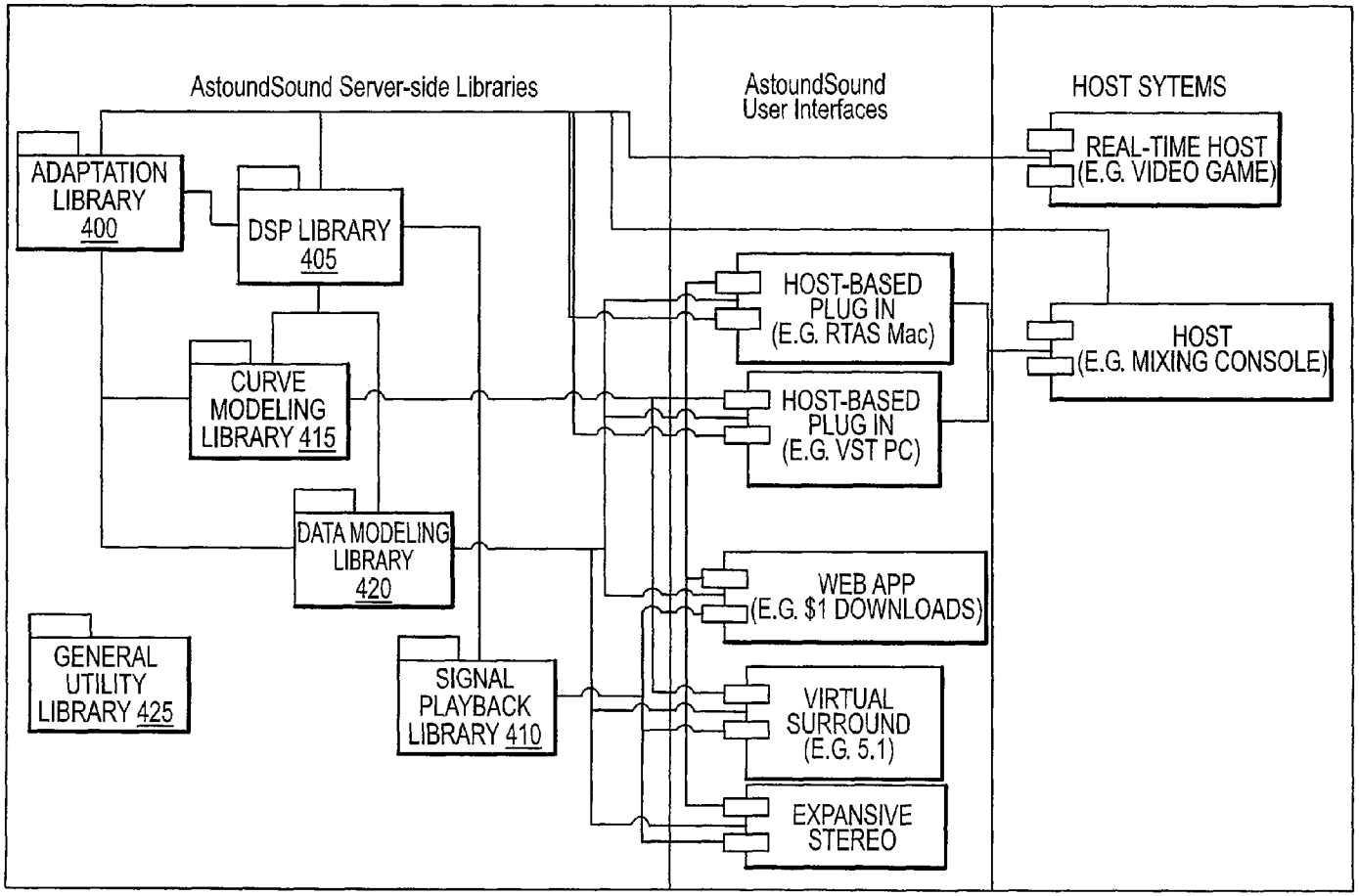
FIG. 4 depicts a high level view of the software architecture for one embodiment of the present invention.

FIG. 4 depicts a high level view of the software architecture, which for one embodiment of the present invention, utilizes a client-server software architecture. Such an architecture enables instantiation of the present invention in several different forms including, but not limited to, a professional audio engineer application for 4D audio post-processing, a professional audio engineer tool for simulating multi-channel presentation formats (e.g., 5.1 audio) in 2-channel stereo output, a "pro-sumer" (e.g., "professional consumer") application for home audio mixing enthusiasts and small independent studios to enable symmetric 3D localization post-processing and a consumer application that real-time localizes stereo files given a set of pre-selected virtual stereo speaker positions. All these applications utilize the same underlying processing principles and, often, code.

As shown in FIG. 4, in one exemplary embodiment there are several server side libraries. The host system adaptation library 400 provides a collection of adaptors and interfaces that allow direct communication between a host application and the server side libraries. The digital signal processing library 405 includes the filter and audio processing software routines that transform input signals into 3D and 4D localized signals. The signal playback library 410 provides basic playback functions such as play, pause, fast forward, rewind and record for one or more processed audio signals. The curve modeling library 415 models static 3D points in space for virtual sound sources and models dynamic 4D paths in space traversed over time. The data modeling library 420 models input and system parameters typically including the musical instrument digital interface settings, user preference settings, data encryption and data copy protection. The general utilities library 425 provides commonly used functions for all the libraries such as coordinate transformations, string manipulations, time functions and base math functions.

Various embodiments of the present invention may be employed in various host systems including video game consoles 430, mixing consoles 435, host-based plug-ins including, but not limited to, a real time audio suite interface 440, a TDM audio interface, virtual studio technology interface 445, and an audio unit interface, or in stand alone applications running on a personal computing device (such as a desktop or laptop computer), a Web based application 450, a virtual surround application 455, an expansive stereo application 460, an iPod or other MP3 playback device, SD radio receiver, cell phone, personal digital assistant or other handheld computer device, compact disc ("CD") player, digital versatile disk ("DVD") player, other consumer and professional audio playback or manipulation electronics systems or applications, etc. to provide a virtual sound source appearing at an arbitrary position in space when the processed audio file is played back through speakers or headphones.

That is, the spatialized waveform may be played back through standard audio playback apparatus with no special decoding equipment required to create the spatial illusion of the spatialized audio emanating from the virtual sound source location during playback. In other words, unlike current audio spatialization techniques such as DOLBY, LOGIC7, DTS, and so forth, the playback apparatus need not include any particular programming or hardware to accurately reproduce the spatialization of the input waveform. Similarly, spatialization may be accurately experienced from any speaker configuration, including headphones, two-channel audio, three- or four-channel audio, five-channel audio or more, and so forth, either with or without a subwoofer.

Figure 5:
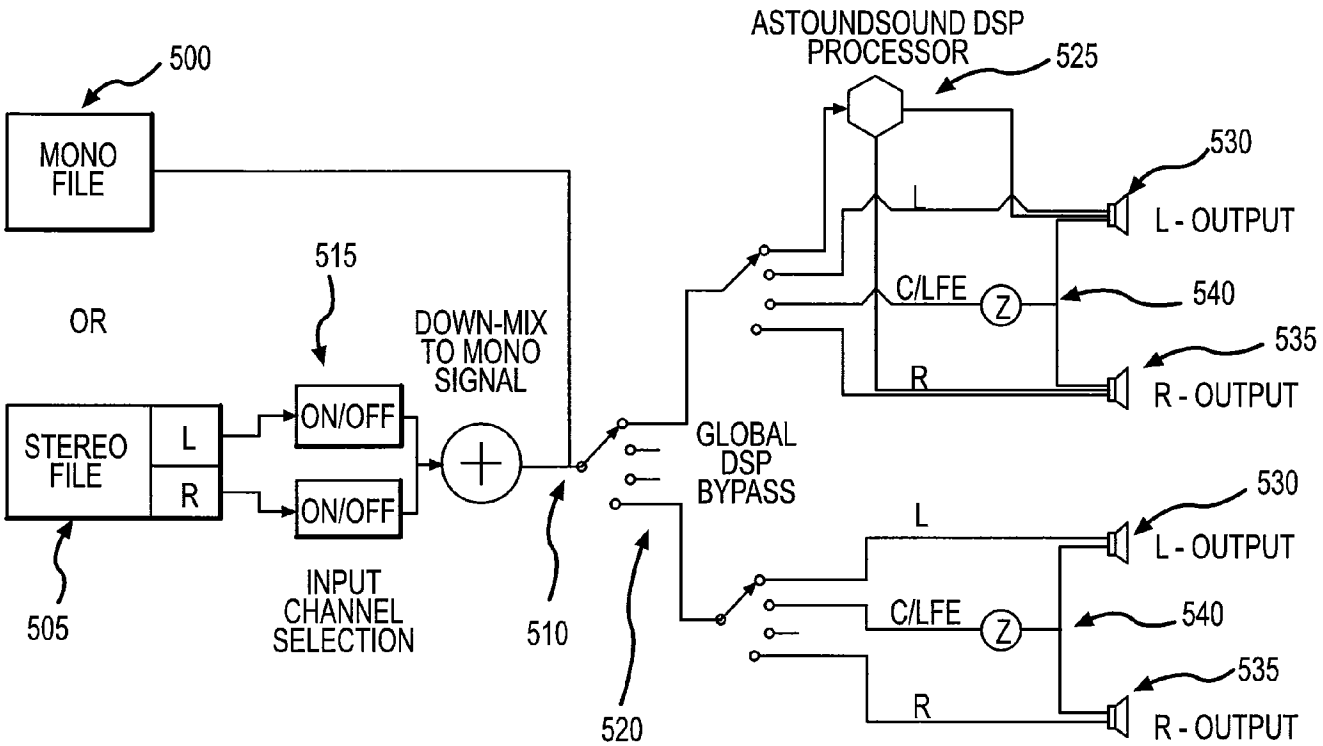
FIG. 5 depicts the signal processing chain for a monaural or stereo signal source for one embodiment of the present invention.

FIG. 5 depicts the signal processing chain for a monaural 500 or stereo 505 audio source input file or data stream (audio signal from a plug-in card such as a sound card). Because a single source is generally placed in 3D space, multi-channel audio sources such as stereo are mixed down to a single monaural channel 510 before being processed by the digital signal processor ("DSP") 525. Note that the DSP may be implemented on special purpose hardware or may be implemented on a CPU of a general purpose computer. Input channel selectors 515 enable either channel of a stereo file, or both channels, to be processed. The single monaural channel is subsequently split into two identical input channels that may be routed to the DSP 525 for further processing.

Some embodiments of the present invention enable multiple input files or data streams to be processed simultaneously. In general, FIG. 5 is replicated for each additional input file being processed simultaneously. A global bypass switch 520 enables all input files to bypass the DSP 525. This is useful for "A/B" comparisons of the output (e.g., comparisons of processed to unprocessed files or waveforms).

Additionally, each individual input file or data stream can be routed directly to the left output 530, right output 535 or center/low frequency emissions output 540, rather than passing through the DSP 525. This may be used, for example, when multiple input files or data streams are processed concurrently and one or more files will not be processed by the DSP. For example, if only the left-front and right-front channel will be localized, a non-localized center channel may be required for context and would be routed around the DSP. Additionally, audio files or data streams having extremely low frequencies (for example, a center audio file or data stream having frequencies generally in the range of 20-500 Hz) may not need to be spatialized, insofar as most listeners typically have difficulty pinpointing the origin of low frequencies. Although waveforms having such frequencies may be spatialized by use of a HRTF filter, the difficulty most listeners would experience in detecting the associated sound localization cues minimizes the usefulness of such spatialization. Accordingly, such audio files or data streams may be routed around the DSP to reduce computing time and processing power required in computer-implemented embodiments of the present invention.

Figure 6:
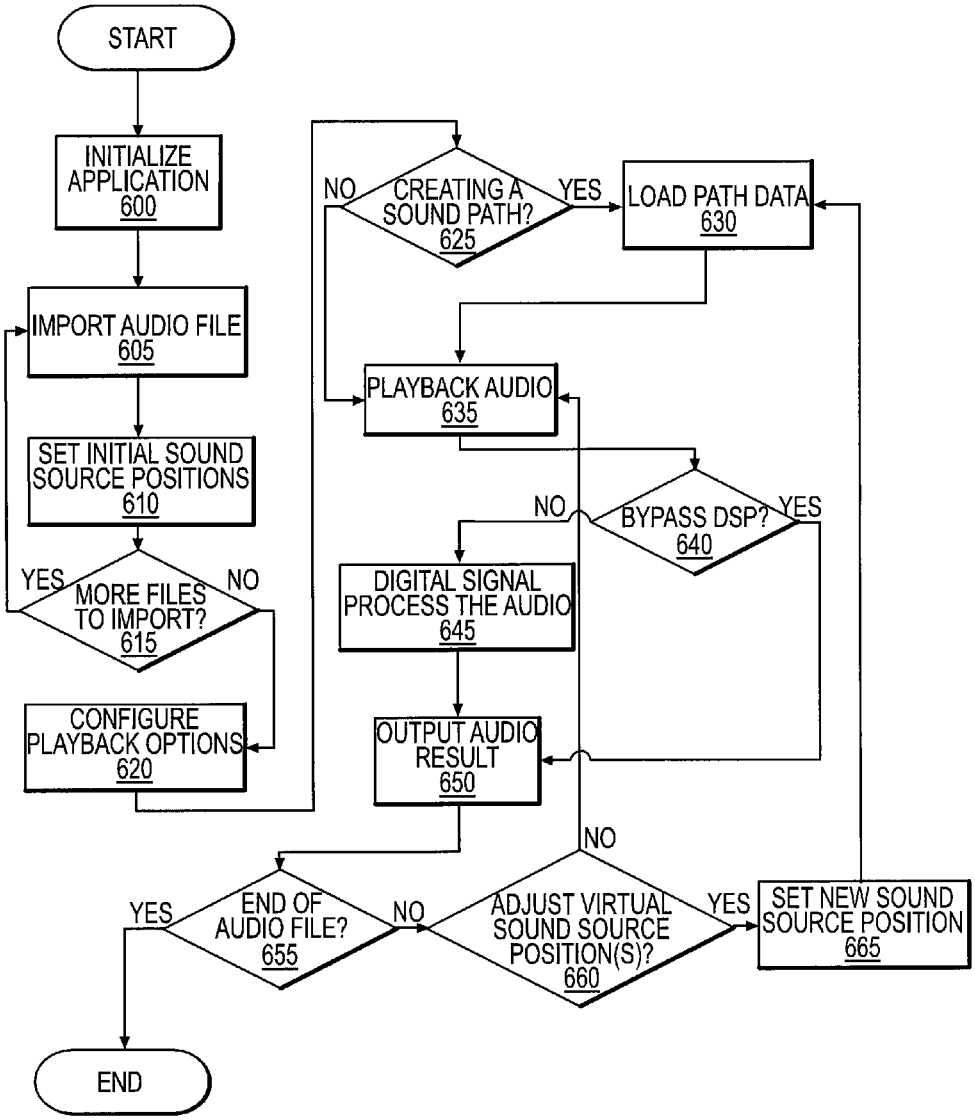
FIG. 6 is a flowchart of the high level software process flow for one embodiment of the present invention.

FIG. 6 is a flowchart of the high level software process flow for one embodiment of the present invention. The process begins in operation 600, where the embodiment initializes the software. Then operation 605 is executed. Operation 605 imports an audio file or a data stream from a plug-in to be processed. Operation 610 is executed to select the virtual sound source position for the audio file if it is to be localized or to select pass-through when the audio file is not being localized. In operation 615, a check is performed to determine if there are more input audio files to be processed. If another audio file is to be imported, operation 605 is again executed. If no more audio files are to be imported, then the embodiment proceeds to operation 620.

Operation 620 configures the playback options for each audio input file or data stream. Playback options may include, but are not limited to, loop playback and channel to be processed (left, right, both, etc.). Then operation 625 is executed to determine if a sound path is being created for an audio file or data stream. If a sound path is being created, operation 630 is executed to load the sound path data. The sound path data is the set of HRTF filters used to localize the sound at the various three-dimensional spatial locations along the sound path, over time. The sound path data may be entered by a user in real-time, stored in persistent memory, or in other suitable storage means. Following operation 630, the embodiment executes operation 635, as described below. However, if the embodiment determines in operation 625 that a sound path is not being created, operation 635 is accessed instead of operation 630 (in other words, operation 630 is skipped).

Operation 635 plays back the audio signal segment of the input signal being processed. Then operation 640 is executed to determine if the input audio file or data stream will be processed by the DSP. If the file or stream is to be processed by the DSP, operation 645 is executed. If operation 640 determines that no DSP processing is to be performed, operation 650 is executed.

Operation 645 processes the audio input file or data stream segment through the DSP to produce a localized stereo sound output file. Then operation 650 is executed and the embodiment outputs the audio file segment or data stream. That is, the input audio may be processed in substantially real time in some embodiments of the present invention. In operation 655, the embodiment determines if the end of the input audio file or data stream has been reached. If the end of the file or data stream has not been reached, operation 660 is executed. If the end of the audio file or data stream has been reached, then processing stops.

Operation 660 determines if the virtual sound position for the input audio file or data stream is to be moved to create 4D sound. Note that during initial configuration, the user specifies the 3D location of the sound source and may provide additional 3D locations, along with a time stamp of when the sound source is to be at that location. If the sound source is moving, then operation 665 is executed. Otherwise, operation 635 is executed.

Operation 665 sets the new location for the virtual sound source. Then operation 630 is executed.

It should be noted that operations 625, 630, 635, 640, 645, 650, 655, 660, and 665 are typically executed in parallel for each input audio file or data stream being processed concurrently. That is, each input audio file or data stream is processed, segment by segment, concurrently with the other input files or data streams.

4. Specifying Sound Source Locations and Binaural Filter Interpolation

Figure 7:
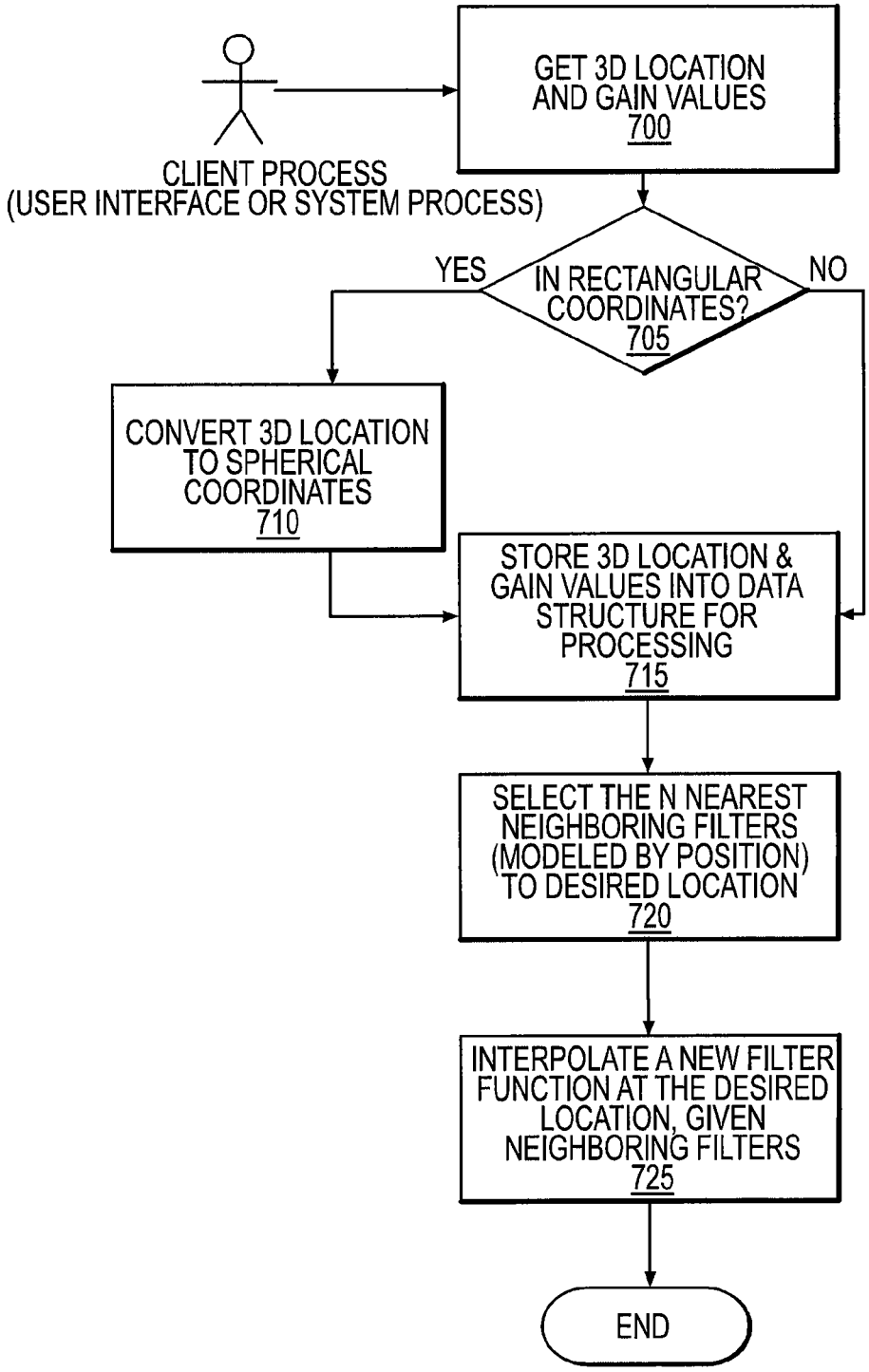
FIG. 7 depicts how a 3D location of a virtual sound source is set.

FIG. 7 shows the basic process employed by one embodiment of the present invention for specifying the location of a virtual sound source in 3D space. Operation 700 is executed to obtain the coordinates of the 3D sound location. The user typically inputs the 3D source location via a user interface. Alternatively, the 3D location can be input via a file or a hardware device. The 3D sound source location may be specified in rectangular coordinates (x, y, z) or in spherical coordinates (r, theta, phi). Then operation 705 is executed to determine if the sound location is in rectangular coordinates. If the 3D sound location is in rectangular coordinates, operation 710 is executed to convert the rectangular coordinates into spherical coordinates. Then operation 715 is executed to store the spherical coordinates of the 3D location in an appropriate data structure for further processing along with a gain value. A gain value provides independent control of the "volume" of the signal. In one embodiment separate gain values are enabled for each input audio signal stream or file.

As previously discussed, one embodiment of the present invention stores 7,337 pre-defined binaural filters, each at a discrete location on the unit sphere. Each binaural filter has two components, a $HRTF_L$ filter (generally approximated by an impulse response filter, e.g., $FIR_L$ filter) and a $HRTF_R$ filter (generally approximated by an impulse response filter, e.g., $FIR_R$ filter), collectively, a filter set. Each filter set may be provided as filter coefficients in HRIR form located on the unit sphere. These filter sets may be distributed uniformly or non-uniformly around the unit sphere for various embodiments. Other embodiments may store more or fewer binaural filter sets. After operation 715, operation 720 is executed. Operation 720 selects the nearest N neighboring filters when the 3D location specified is not covered by one of the pre-defined binaural filters. Then operation 725 is executed. Operation 725 generates a new filter for the specified 3D location by interpolation of the three nearest neighboring filters. Other embodiments may generate a new filter using more or fewer pre-defined filters.

It should be understood that the HRTF filters are not waveform-specific. That is, each HRTF filter may spatialize audio for any portion of any input waveform, causing it to apparently emanate from the virtual sound source location when played back through speakers or headphones.

Figure 8:
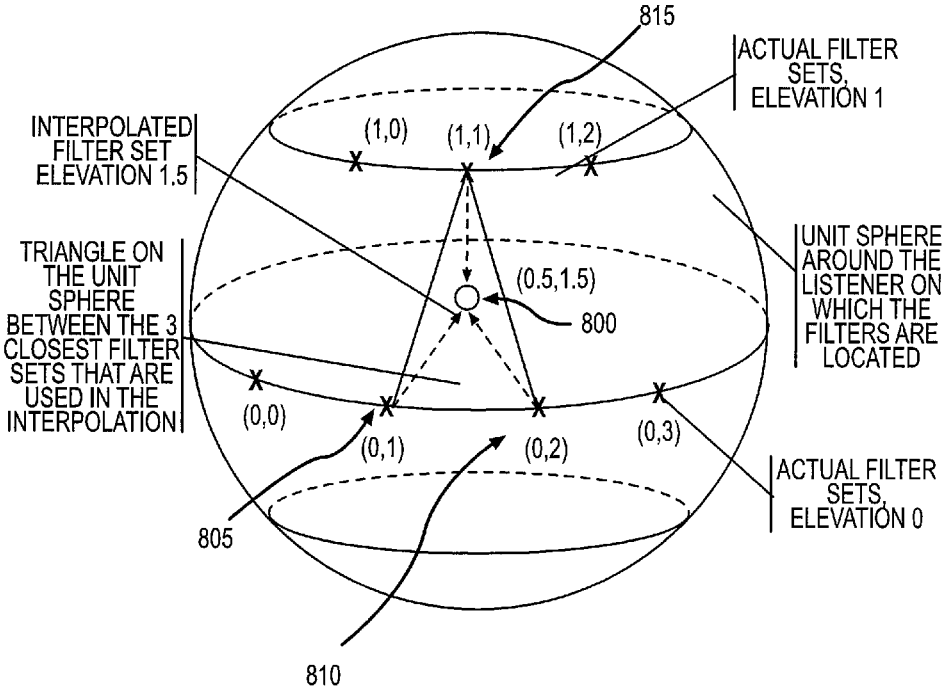
FIG. 8 depicts how a new HRTF filter may be interpolated from existing pre-defined HRTF filters.

FIG. 8 depicts several pre-defined HRTF filter sets, each denoted by an X, located on the unit sphere that are utilized to interpolate a new HRTF filter located at location 800. Location 800 is a desired 3D virtual sound source location, specified by its azimuth and elevation (0.5, 1.5). This location is not covered by one of the pre-defined filter sets. In this illustration, three nearest neighboring pre-defined filter sets 805, 810, 815 are used to interpolate the filter set for location 800. Selecting the appropriate three neighboring filter sets for location 800 is done by minimizing the distance D between the desired position and all stored positions on the unit sphere according to the Pythagorean distance relation:

$$D=SQRT((e_x-e_k)^2+(a_x-a_k)^2))$$

where $e_k$ and $a_k$ are the elevation and azimuth at stored location k and $e_x$ and $a_x$ are the elevation and azimuth at the desired location x.

Thus, filter sets 805, 810, 815 may be used by one embodiment to obtain the interpolated filter set for location 800. Other embodiments may use more or fewer pre-defined filters during the interpolation process. The accuracy of the interpolation process depends on the density of the grid of pre-defined filters in the vicinity of the source location being localized, the precision of the processing (e.g., 32 bit floating point, single precision) and the type of interpolation used (e.g., linear, sin c, parabolic, etc.). Because the coefficients of the filters represent a band limited signal, band limited interpolation (sin c interpolation) may provide an optimal way of creating new filter coefficients.

The interpolation can be done by polynomial or band-limited interpolation between the pre-defined filter coefficients. In one implementation, interpolation between two nearest neighbors is performed using an order one polynomial, i.e., linear interpolation, to minimize the processing time. In this particular implementation, each interpolated filter coefficient may be obtained by setting $$\alpha=x-k \text{ and computing } h_t(d_x)=\alpha h_t(d_{k+1})+(1-\alpha)h_t(d_k).$$

where $h_t(d_x)$ is the interpolated filter coefficient at location x, $h_t(d_{k+1})$ and $h_t(d_k)$ are the two nearest neighbor pre-defined filter coefficients.

Figure 9:
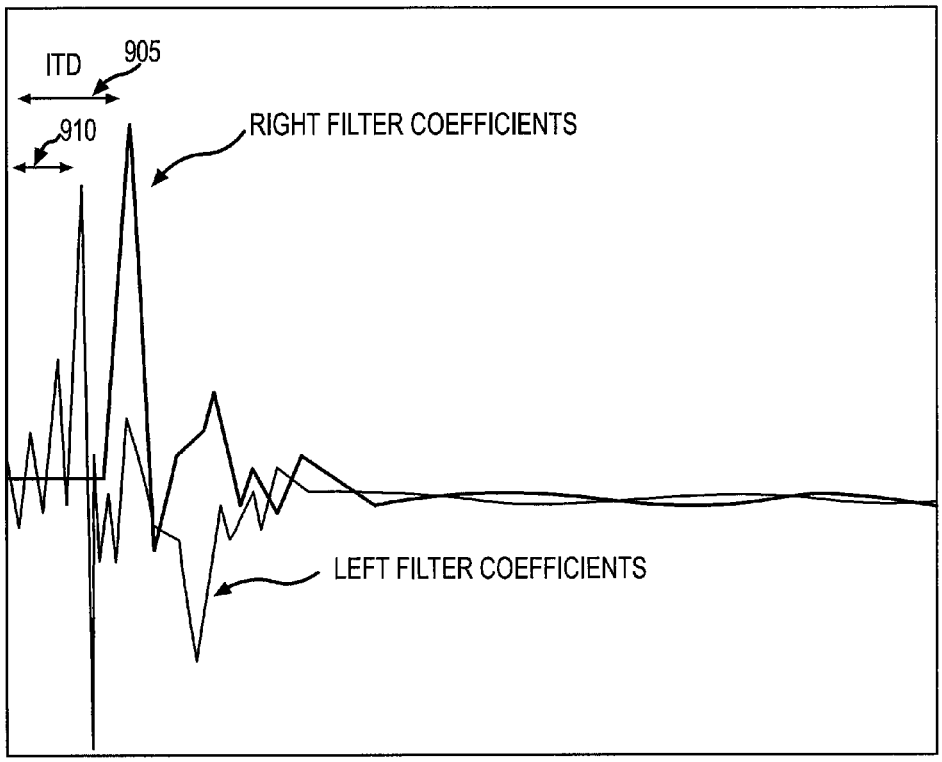
FIG. 9 illustrates the inter-aural time difference between the left and right HRTF filter coefficients.

When interpolating filter coefficients, the inter-aural time difference ("ITD") generally has to be taken into account. Each filter has an intrinsic delay that depends on the distance between the respective ear channel and the sound source as shown in FIG. 9. This ITD appears in the HRIR as a non-zero offset in front of the actual filter coefficients. Therefore, it is generally difficult to create a filter that resembles the HRIR at the desired position x from the known positions k and k+1. When the grid is densely populated with pre-defined filters, the delay introduced by the ITD may be ignored because the error is small. However, when there is limited memory, this may not be an option.

When memory is limited, the ITDs 905, 910 for the right and left ear channel, respectively, should be estimated so that the ITD contribution to the delay, $D_R$ and $D_L$, of the right and left filter, respectively, may be removed during the interpolation process. In one embodiment of the present invention, the ITD may be determined by examining the offset at which the HRIR exceeds 5% of the HRIR maximum absolute value. This estimate is not precise because the ITD is a fractional delay with a delay time D beyond the resolution of the sampling interval. The actual fraction of the delay is determined using parabolic interpolation across the peak in the HRIR to estimate the actual location T of the peak. This is generally done by finding the maximum of a parabola fitted through three known points which can be expressed mathematically as $$p_n=|h_T|-|h_{T-1}|$$

$$p_m=|h_T|-|h_{T+1}|$$

$$D=t+(p_n-p_m)/(2*(p_n+p_m+\epsilon)) \text{ where } \epsilon \text{ is a small number to make sure the denominator is not zero.}$$

The delay D can then be subtracted out from each filter using the phase spectrum in the frequency domain by calculating the modified phase spectrum $\phi'\{H_k\}=\phi\{H_k\}+(D*\pi*k)/N$, where N is the number of transform frequency bins for the FFT. Alternatively, the HRIR can be time shifted using $h'_t=h_{t+D}$ in the time domain.

After the interpolation, the ITD is added back in by delaying the right and left channel by an amount $D_R$ or $D_L$, respectively. The delay is also interpolated, according to the current position of the sound source that is being rendered. That is, for each channel $$D=\alpha D_{k+1}+(1-\alpha)D_k \text{ where } \alpha=x-k.$$

5. Digital Signal Processing and HRTF Filtering

Figure 10:
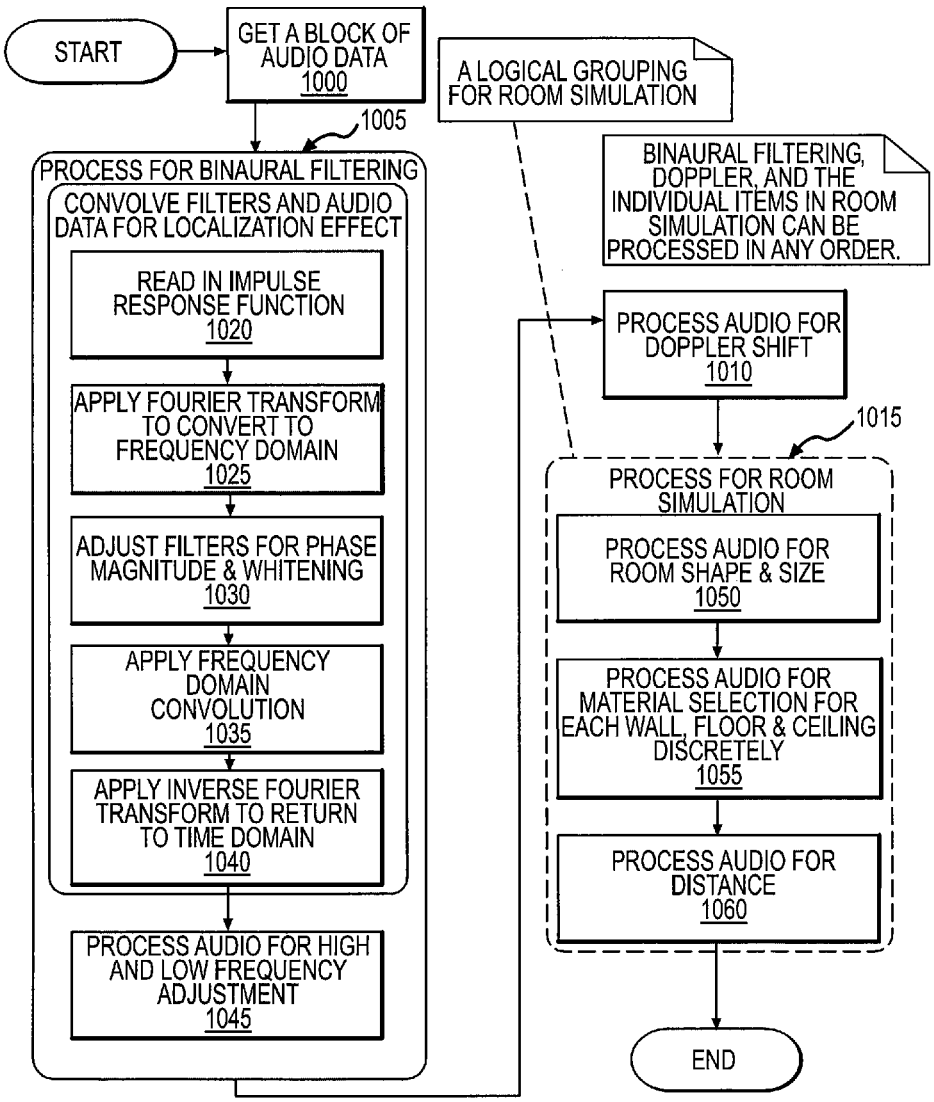
FIG. 10 depicts the DSP software processing flow for sound source localization for one embodiment of the present invention.

Once the binaural filter coefficients for the specified 3D sound locations have been determined, each input audio stream can be processed to provide a localized stereo output. In one embodiment of the present invention, the DSP unit is subdivided into three separate sub processes. These are binaural filtering, Doppler shift processing and ambience processing. FIG. 10 shows the DSP software processing flow for sound source localization for one embodiment of the present invention.

Initially, operation 1000 is executed to obtain a block of audio data for an audio input channel for further processing by the DSP. Then operation 1005 is executed to process the block for binaural filtering. Then operation 1010 is executed to process the block for Doppler shift. Finally, operation 1015 is executed to process the block for room simulation. Other embodiments may perform binaural filtering 1005, Doppler shift processing 1010 and room simulation processing 1015 in a different order.

During the binaural filtering operation 1005, operation 1020 is executed to read in the HRIR filter set for the specified 3D location. Then operation 1025 is executed. Operation 1025 applies a Fourier transform to the HRIR filter set to obtain the frequency response of the filter set, one for the right ear channel and one for the left ear channel. Some embodiments may skip operation 1025 by storing and reading in the filter coefficients in their transformed state to save time. Then operation 1030 is executed. Operation 1030 adjusts the filters for magnitude, phase and whitening. Then operation 1035 is performed.

In operation 1035, the embodiment performs frequency domain convolution on the data block. During this operation, the transformed data block is multiplied by the frequency response of the right ear channel and also by the left ear channel. Then operation 1040 is executed. Operation 1040 performs an inverse Fourier transform on the data block to convert it back to the time domain.

Then operation 1045 is executed. Operation 1045 processes the audio data block for high and low frequency adjustment.

During room simulation processing of the block of audio data (operation 1015), operation 1050 is executed. Operation 1050 processes the block of audio data for room shape and size. Then operation 1055 is executed. Operation 1055 processes the block of audio data for wall, floor and ceiling materials. Then operation 1060 is executed. Operation 1060 processes the block of audio data to reflect the distance from the 3D sound source location and the listener's ear.

Human ears deduce the position of a sound cue from various interactions of the sound cue with the surroundings and the human auditory system that includes the outer ear and pinna. Sound from different locations creates different resonances and cancellations in the human auditory system that enables the brain to determine the sound cue's relative position in space.

These resonances and cancellations created by the interactions of the sound cue with the environment, the ear and the pinna are essentially linear in nature and can therefore be captured by expressing the localized sound as the response of a linear time invariant ("LTI") system to an external stimulus, as may be calculated by various embodiments of the present invention. (Generally, the calculations, formulae and other operations set forth herein may be, and typically are, executed by embodiments of the present invention. Thus, for example, an exemplary embodiment may take the form of appropriately-configured computer hardware or software that may perform the tasks, calculations, operations and so forth disclosed herein. Accordingly, discussions of such tasks, formulae, operations, calculations and so on (collectively, "data") should be understood to be set forth in the context of an exemplary embodiment including, performing, accessing or otherwise utilizing such data.)

The response of any discrete LTI system to a single impulse response is called the "impulse response" of the system. Given the impulse response h(t) of such a system, its response y(t) to an arbitrary input signal s(t) can be constructed by an embodiment through a process called convolution in the time domain. That is, $y(t)=s(t)\cdot h(t)$ where · denotes convolution. However, convolution in the time domain generally is very expensive in terms of computational power because the processing time for a standard time domain convolution rises exponentially with the number of points in the filter. Since convolution in the time domain corresponds to multiplication in the frequency domain, it may be more efficient to perform the convolution in the frequency domain using a technique called Fast Fourier Transform ("FFT") convolution for long filters. That is, $y(t)=F^{-1}\{S(f)*H(f)\}$ where $F^{-1}$ is the inverse Fourier transform, S(f) is the Fourier transform of the input signal and H(f) is the Fourier transform of the impulse response of the system. It should be noted that the time required for FFT convolution increases very slowly, only as the logarithm of the number of points in the filter.

The discrete-time, discrete-frequency Fourier transform of the input signal s(t) is given as $$F\{s(t)\} = S(k) = \sum_{k=0}^{N-1} s(t)e^{-j\omega t},\ \omega = \frac{2\pi k}{N}$$

where k is called the "frequency bin index," ω is the angular frequency and N is the Fourier transform frame (or window) size. Therefore, FFT convolution may be expressed as $y(t)=F^{-1}\{S(k)*H(k)\}$ where $F^{-1}$ is the inverse Fourier transform. Thus, convolution in the frequency domain by an embodiment for a real valued input signal s(t) requires two FFTs and N/2+1 complex multiplications. For a long h(t), i.e., a filter with many coefficients, considerable savings in processing time may be achieved by using FFT convolution instead of time domain convolution. However, when FFT convolution is performed, the FFT frame size generally should be long enough such that circular convolution does not take place. Circular convolution may be avoided by making the FFT frame size equal to or greater than the size of the output segment produced by the convolution. For, example, when an input segment of length N is convolved with a filter of length M, the output segment produced is of length N+M−1. Thus the FFT frame size of N+M−1 or larger may be used. In general, N+M−1 may be chosen as a power of 2 for purposes of computational efficiency and ease of implementing the FFT. One embodiment of the present invention uses a data block size N=2048 and a filter with M=1920 coefficients. The FFT frame size used is 4096, or the next highest power of two that can hold the output segment of size 3967 to avoid circular convolution effects. In general, both the filter coefficients and the data block are zero padded to be of size N+M−1, the same as the FFT frame size, before they are Fourier transformed.

Some embodiments of the present invention take advantage of the symmetry of the FFT output for a real-valued input signal. The Fourier transform is a complex valued operation. As such, input and output values have real and imaginary components. In general, audio data are usually real signals. For a real-valued input signal, the output of the FFT is a conjugate symmetric function. That is, half of its values will be redundant. This can be expressed mathematically as $$S(e^{-j\omega t})=\overline{S(e^{j\omega t})}$$

This redundancy may be utilized by some embodiments of the present invention to transform two real signals at the same time using a single FFT. The resulting transform is a combination of the two symmetric transforms resulting from the two input signals (one signal being purely real and the other being purely imaginary). The real signal is Hermitian symmetric and the imaginary signal is anti-Hermitian symmetric. To separate out the two transforms, $T_1$ and $T_2$, at each frequency bin f, f ranging from 0 to N/2+1, the sum or difference of the real and imaginary parts at f and −f are used to generate the two transforms, $T_1$ and $T_2$.

This may be expressed mathematically as $$reT_1(f)=reT_1(-f)=0.5*(re(f)+re(-f))$$

$$imT_1(f)=0.5*(re(f)-re(-f))$$

$$imT_1(-f)=-0.5*(re(f)-re(-f))$$

$$reT_2(f)=reT_2(-f)=0.5*(im(f)+im(-f))$$

$$imT_2(f)=-0.5*(re(f)-re(-f))$$

$imT_2(-f)=0.5*(re(f)-re(-f))$ where re(f), im(f), re(−f) and im(−f) are the real and imaginary components of the initial transform at frequency bin f and −f; $reT_1(f)$, $imT_1(f)$, $reT_1(-f)$ and $imT_1(-f)$ are the real and imaginary components of transform $T_1$ at frequency bin f and −f; and $reT_2(f)$, $imT_2(f)$, $reT_2(-f)$ and $imT_2(-f)$ are the real and imaginary components of transform $T_2$ at frequency bin f and −f.

Figure 11:
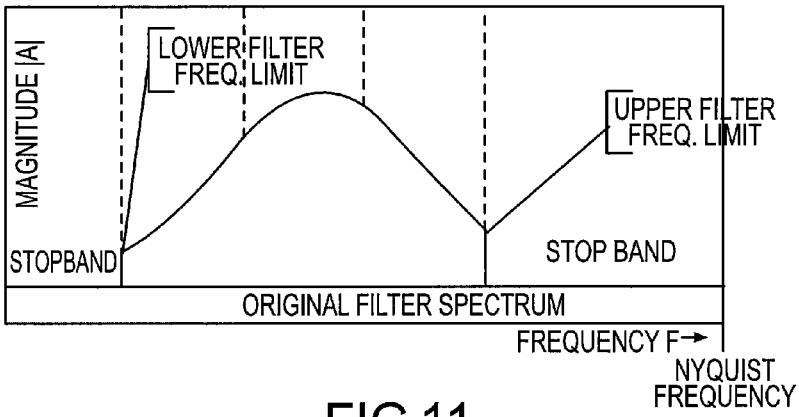
FIG. 11 depicts the low-frequency and high-frequency roll off of a HRTF filter.
Figure 12:
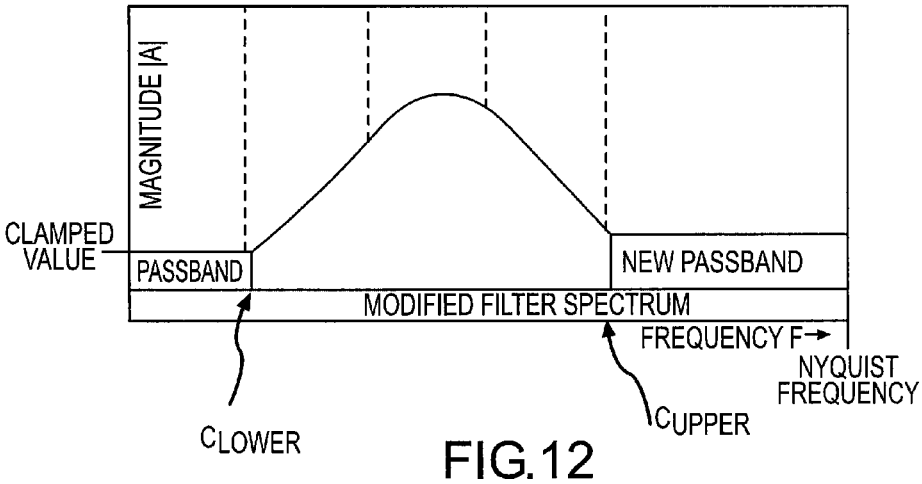
FIG. 12 depicts how frequency and phase clamping may be used to extend the frequency and phase response of a HRTF filter.

Due to the nature of the HRTF filters, they typically have an intrinsic roll-off at both the high-frequency and low-frequency end as shown by FIG. 11. This filter roll-off may not be noticeable for individual sounds (such as a voice or single instrument) because most individual sounds have negligible low and high frequency content. However, when an entire mix is processed by an embodiment of the present invention, the effects of filter roll-off may be more noticeable. One embodiment of the present invention eliminates filter roll-off by clamping the magnitude and phase values at frequencies above an upper cutoff frequency, $c_{upper}$, and below a lower cutoff frequency, $c_{lower}$ as shown in FIG. 12. This is operation 1045 of FIG. 10.

The clamping effect may be expressed mathematically as $$\text{if } (k>c_{upper})|S_k|=|S_{Cupper}|\cdot\phi\{S_k\}=\phi\{S_{Cupper}\}$$

$$\text{if } (k<c_{lower})|S_k=|S_{Clower}|\cdot\phi\{S_k\}=\phi\{S_{Clower}\}$$

The clamping is effectively a zero-order hold interpolation. Other embodiments may use other interpolation methods to extend the low and high frequency pass bands such as using the average magnitude and phase of the lowest and highest frequency band of interest.

Some embodiments of the present invention may adjust the magnitude and phase of the HRTF filters (operation 1030 of FIG. 10) to adjust the amount of localization introduced. In one embodiment, the amount of localization is adjustable on a scale of 0-9. The localization adjustment may be split into two components, the effect of the HRTF filters on the magnitude spectrum and the effect of the HRTF filters on the phase spectrum.

The phase spectrum defines the frequency dependent delay of the sound waves reaching and interacting with the listener and his pinna. The largest contribution to the phase terms is generally the ITD which results in a large linear phase offset. In one embodiment of the present invention, the ITD is modified by multiplying the phase spectrum with a scalar α and optionally adding an offset β such that $$\phi\{S_k\}=\phi\{S_k\}*\alpha+k*\beta.$$

Generally, for the phase adjustment to work properly, the phase should be unwrapped along the frequency axis. Phase unwrapping corrects the radian phase angles by adding or subtracting multiples of 2π when there is an absolute jump between consecutive frequency bins greater than π radians. That is, the phase angle at frequency bin k=1 is changed by multiples of 2π such that the difference in phase between frequency bin k and frequency bin k=1 is minimized.

The magnitude spectrum of the localized audio signal results from the resonances and cancellations of a sound wave at a given frequency with any near field objects and the listener's head. The magnitude spectrum typically contains several peak frequencies at which resonances occur as a result of the sound wave's interaction with the listener's head and pinna. The frequency of these resonances typically are about the same for all listener's due to the generally low variance in head, outer ear and body sizes. The location of the resonance frequencies may impact the localization effect such that alterations of the resonance frequencies may impact the effect of the localization.

The steepness of a filter determines its selectiveness, separation, or "quality," a property generally expressed by the unitless factor Q given by $1/Q=2\sinh(\ln(2)\lambda/2)$ where λ is the bandwidth of the filter in octaves. A higher filter separation results in more pronounced resonances (steeper filter slopes) which in turn enhances or attenuates the localization effect.

In one embodiment of the present invention, a non-linear operator is applied to all magnitude spectrum terms to adjust the localization effect. Mathematically, this may be expressed as $$|S_k|=(1-\alpha)*|S_k|+\alpha*|S_k|^{\beta};\alpha=0 \text{ to } 1,\beta=0 \text{ to } n$$

In this embodiment, α is the intensity of the magnitude scaling and β is a magnitude scaling exponent. In one particular embodiment β=2 to reduce the magnitude scaling to a computationally efficient form $$|S_k|=(1-\alpha)*|S_k|+\alpha*|S_k|*|S_k|;\alpha=0 \text{ to } 1$$

Figure 13:
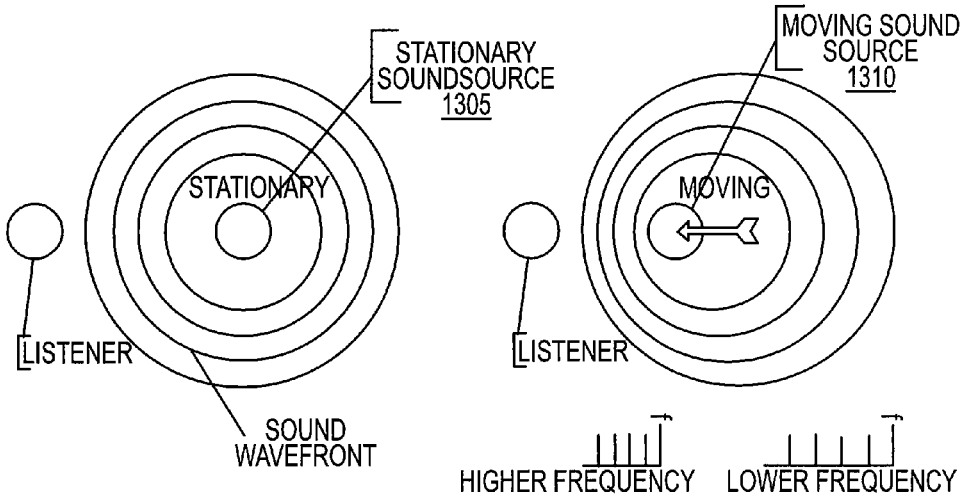
FIG. 13 illustrates the Doppler shift effect on stationary and moving sound sources.

After the block of audio data has been binaural filtered, some embodiments of the present invention may further process the block of audio data to account for or create a Doppler shift (operation 1010 of FIG. 10). Other embodiments may process the block of data for Doppler shift before the block of audio data is binaural filtered. Doppler shift is a change in the perceived pitch of a sound source as a result of relative movement of the sound source with respect to the listener as illustrated by FIG. 13. As FIG. 13 illustrates, a stationary sound source does not change in pitch. However, a sound source 1310 moving toward the listener is perceived to be of higher pitch while a sound source moving away from the listener is perceived to be of lower pitch. Because the speed of sound is 334 meters/second, a few times higher than the speed of a moving source, the Doppler shift is easily noticeable even for slow moving sources. Thus, the present embodiment may be configured such that the localization process may account for Doppler shift to enable the listener to determine the speed and direction of a moving sound source.

Figure 14:
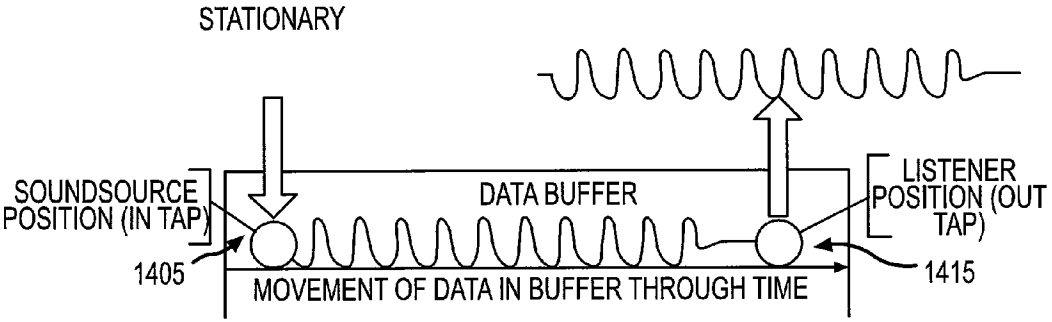
FIG. 14 illustrates how the distance between a listener and a stationary sound source is perceived as a simple delay.

The Doppler shift effect may be created by some embodiments of the present invention using digital signal processing. A data buffer proportional in size to the maximum distance between the sound source and the listener is created. Referring now to FIG. 14, the block of audio data is fed into the buffer at the "in tap" 1400 which may be at index 0 of the buffer and corresponds to the position of the virtual sound source. The "output tap" 1415 corresponds to the listener position. For a stationary virtual sound source, the distance between the listener and the virtual sound source will be perceived as a simple delay, as shown in FIG. 14.

Figure 15:
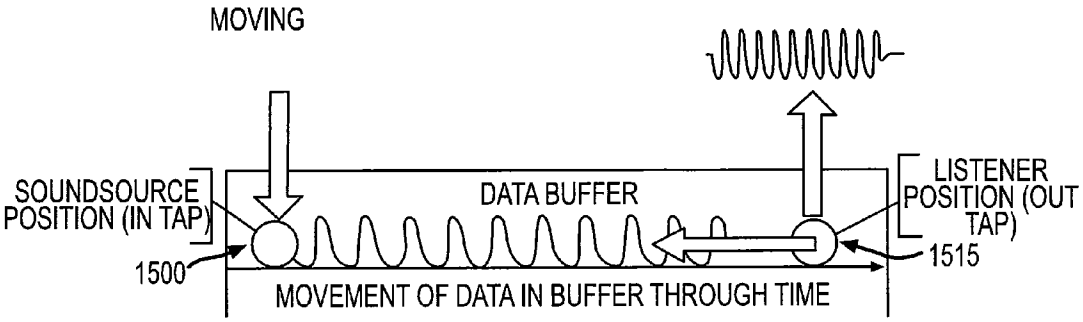
FIG. 15 illustrates how moving the listener position or source position changes the perceived pitch of the sound source.

When a virtual sound source is moved along a path, the Doppler shift effect may be introduced by moving the listener tap or sound source tap to change the perceived pitch of the sound. For example, as illustrated in FIG. 15, if the tap position 1515 of the listener is moved to the left, which means moving toward the sound source 1500, the sound wave's peaks and valleys will hit the listener's position faster, which is equivalent to an increase in pitch. Alternatively, the listener tap position 1515 can be moved away from the sound source 1500 to decrease the perceived pitch.

The present embodiment may separately create a Doppler shift for the left and right ear to simulate sound sources that are not only moving radially but also circularly with respect to the listener. Because the Doppler shift can create pitches higher in frequency when a source is approaching the listener, and because the input signal may be critically sampled, the increase in pitch may result in some frequencies falling outside the Nyquist frequency, thereby creating aliasing. Aliasing occurs when a signal sampled at a rate $S_r$ contains frequencies at or above the Nyquist frequency=$S_r/2$ (e.g., a signal sampled at 44.1 kHz has a Nyquist frequency of 22,050 Hz and the signal should have frequency content less than 22,050 Hz to avoid aliasing). Frequencies above the Nyquist frequency appear at lower frequency locations, causing an undesired aliasing effect. Some embodiments of the present invention may employ an anti-aliasing filter prior to or during the Doppler shift processing so that any changes in pitch will not create frequencies that alias with other frequencies in the processed audio signal.

Because the left and right ear Doppler shift are processed independently of each other, some embodiments of the present invention executed on a multiprocessor system may utilize separate processors for each ear to minimize overall processing time of the block of audio data.

Some embodiments of the present invention may perform ambience processing on a block of audio data (operation 1015 of FIG. 10). Ambience processing includes reflection processing (operations 1050 and 1055 of FIG. 10) to account for room characteristics and distance processing (operation 1060 of FIG. 10).

The loudness (decibel level) of a sound source is a function of distance between the sound source and the listener. On the way to the listener, some of the energy in a sound wave is converted to heat due to friction and dissipation (air absorption). Also, due to wave propagation in 3D space, the sound wave's energy is distributed over a larger volume of space when the listener and the sound source are further apart (distance attenuation).

In an ideal environment, the attenuation A (in dB) in sound pressure level between the listener at distance d2 from the sound source, whose reference level is measured at a distance of d1 can be expressed as $$A=20\log 10(d2/d1)$$

This relationship is generally only valid for a point source in a perfect, loss free atmosphere without any interfering objects. In one embodiment of the present invention, this relationship is used to compute the attenuation factor for a sound source at distance d2.

Sound waves generally interact with objects in the environment, from which they are reflected, refracted or diffracted. Reflection off a surface results in discrete echoes being added to the signal, while refraction and diffraction generally are more frequency dependent and create time delays that vary with frequency. Therefore, some embodiments of the present invention incorporate information about the immediate surroundings to enhance distance perception of the sound source.

There are several methods that may be used by embodiments of the present invention to model the interaction of sound waves with objects, including ray tracing and reverb processing using comb and all-pass filtering. In ray tracing, reflections of a virtual sound source are traced back from the listener's position to the sound source. This allows for realistic approximation of real rooms because the process models the paths of the sound waves.

In reverb processing using comb and all-pass filtering, the actual environment typically is not modeled. Rather, a realistic sounding effect is reproduced instead. One widely used method involves arranging comb and all-pass filters in serial and parallel configurations as described in a paper "Colorless artificial reverberation," M. R. Schroeder and B. F. Logan, *IRE Transactions*, Vol. AU-9, pp. 209-214, 1961, which is incorporated herein by reference.

Figure 16:
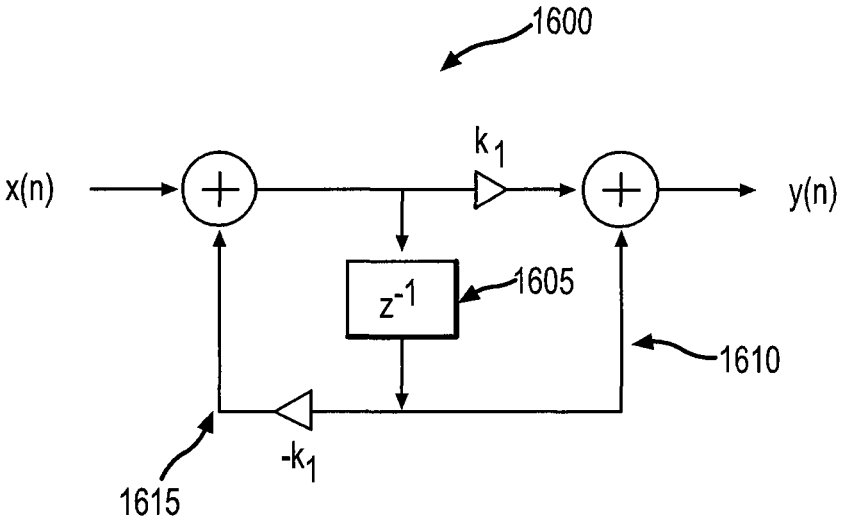
FIG. 16 is a block diagram of an all-pass filter implemented as a delay element with a feed forward and a feedback path.

An all-pass filter 1600 may be implemented as a delay element 1605 with a feed forward 1610 and a feedback 1615 path as shown in FIG. 16. In a structure of all-pass filters, filter i has a transfer function given by $$S_i(z)=(k_i+z^{-1})/(1+k_iz^{-1})$$

Figure 17:
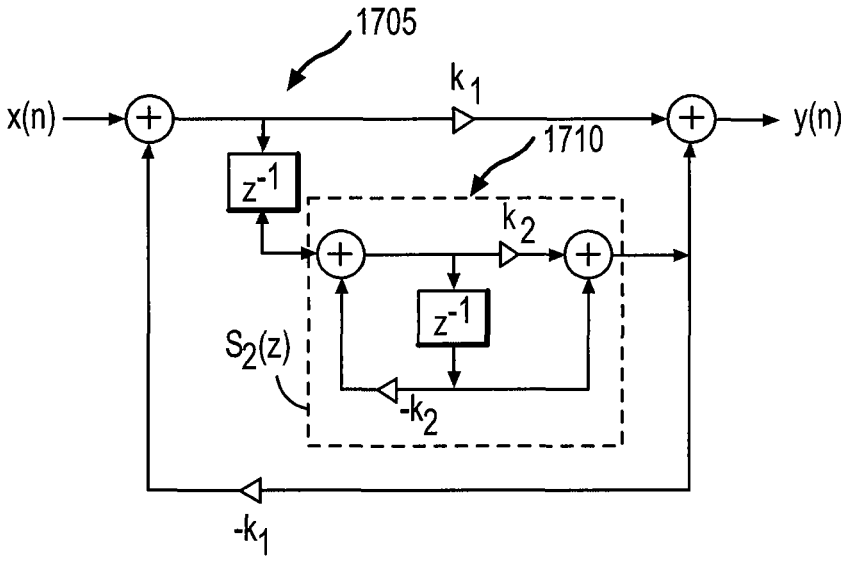
FIG. 17 depicts nesting of all-pass filters to simulate multiple reflections from objects in the vicinity of a virtual sound source being localized.

An ideal all-pass filter creates a frequency dependent delay with a long-term unity magnitude response (hence the name all-pass). As such, the all-pass filter only has an effect on the long-term phase spectrum. In one embodiment of the present invention, all-pass filters 1705, 1710 may be nested to achieve the acoustic effect of multiple reflections being added by objects in the vicinity of the virtual sound source being localized as shown in FIG. 17. In one particular embodiment, a network of sixteen nested all-pass filters is implemented across a shared block of memory (accumulation buffer). An additional 16 output taps, eight per audio channel, simulate the presence of walls, ceiling and floor around the virtual sound source and listener.

Figure 18:
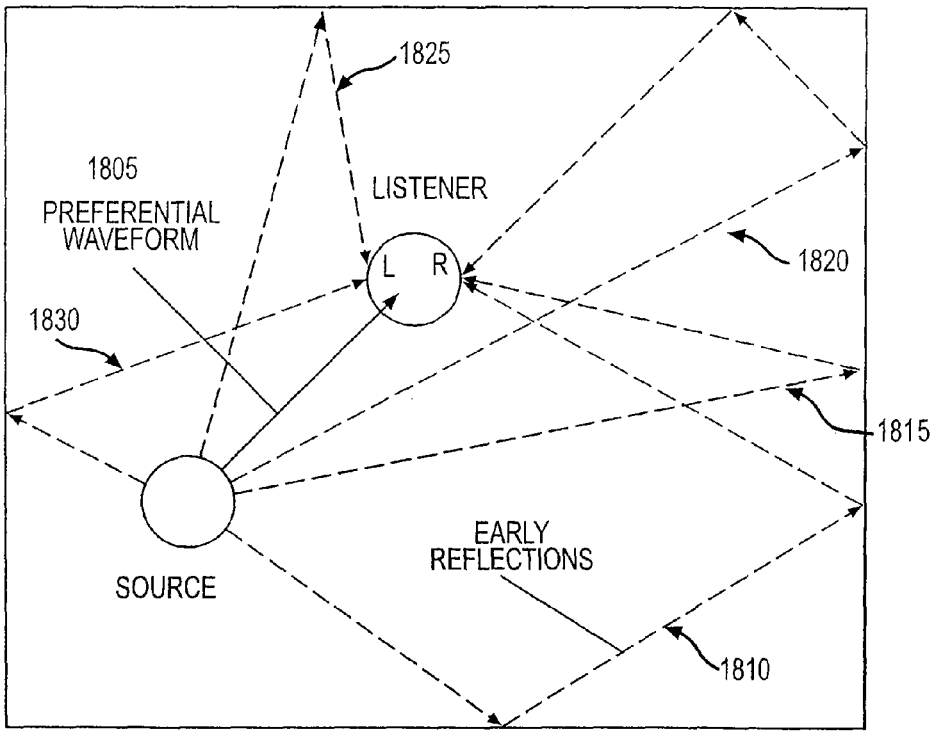
FIG. 18 depicts the results of an all-pass filter model, the preferential waveform (incident direct sound) and the early reflections from the source to the listener.

Taps into the accumulation buffer may be spaced in a way such that their time delays correspond to the first order reflection times and the path lengths between the two ears of the listener and the virtual sound source within the room. FIG. 18 depicts the results of an all-pass filter model, the preferential waveform 1805 (incident direct sound) and early reflections 1810, 1815, 1820, 1825, 1830 from the virtual sound source to the listener.

6. Further Processing Improvements

Under certain conditions, the HRTF filters may introduce a spectral imbalance that can undesirably emphasize certain frequencies. This arises from the fact that there may be large dips and peaks in the magnitude spectrum of the filters that can create an imbalance between adjacent frequency areas if the processed signal has a flat magnitude spectrum.

To counteract the effects of this tonal imbalance without affecting the small scale peaks which are generally used in producing the localization cues, an overall gain factor that varies with frequency is applied to the filter magnitude spectrum. This gain factor acts as an equalizer that smoothes out changes in the frequency spectrum and generally maximizes its flatness and minimizes large scale deviations from the ideal filter spectrum.

One embodiment of the present invention may implement the gain factor as follows. First, the arithmetic mean S' of the entire filter magnitude spectrum is calculated as follows:

$$S' = \frac{2}{N}\sum_{k=0}^{N/2}|S_k|$$

Figure 19:
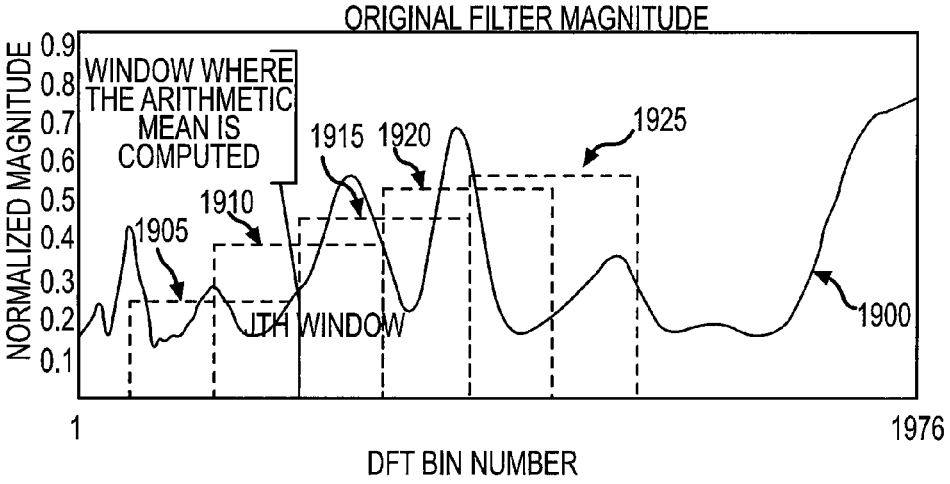
FIG. 19 depicts the use of overlapping windows to break up the magnitude spectrum of a HRTF filter during processing to improve spectral flatness.

Then, the magnitude spectrum 1900 is broken up into small, overlapping windows 1905, 1910, 1915, 1920, 1925 as shown in FIG. 19. For each window, the average spectral magnitude is calculated for the $j_{th}$ frequency band, again by using the arithmetic mean $$S'_j = \frac{1}{D}\sum_{i=0}^{D-1}\left|S_{i-\frac{jD}{2}}\right|$$

where D is the size of the $j_{th}$ window.

Figure 20:
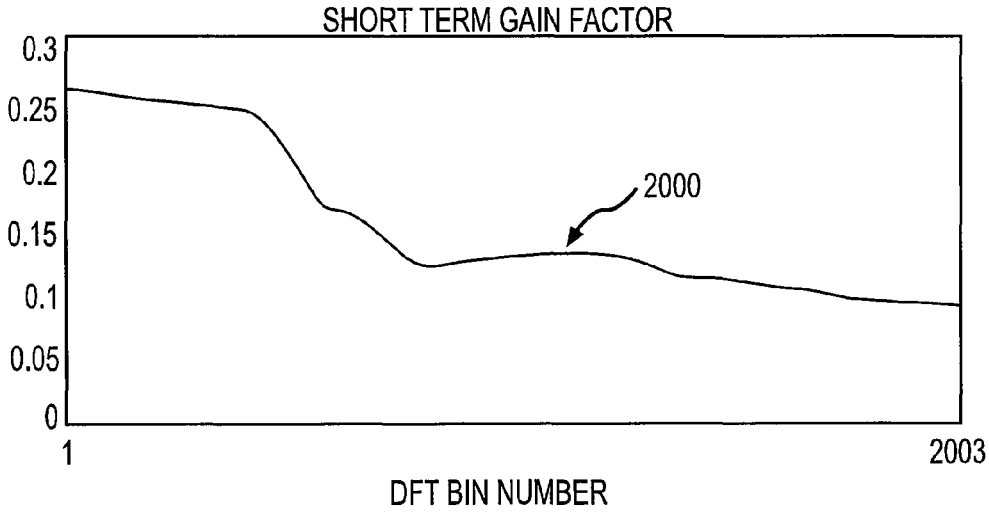
FIG. 20 illustrates a short term gain factor used by one embodiment of the present invention to improve spectral flatness of the magnitude spectrum of a HRTF filter.
Figure 21:
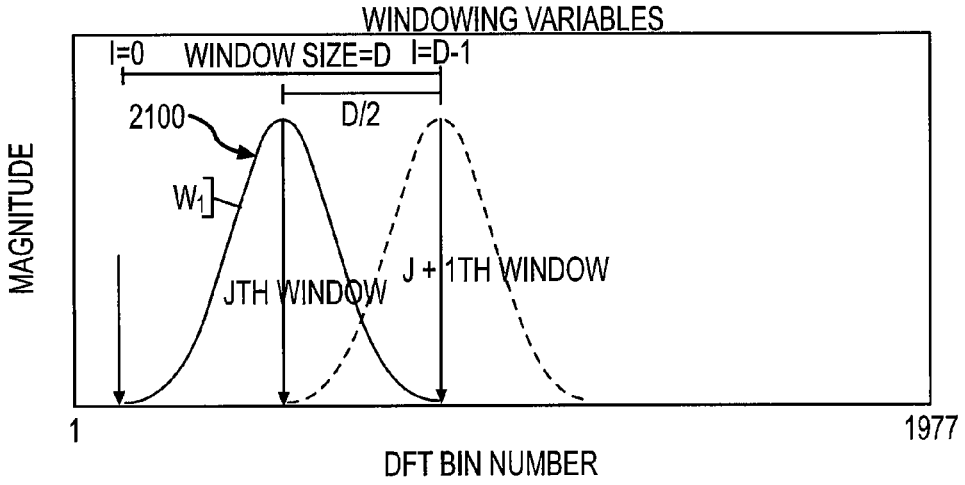
FIG. 21 depicts a Hann window used by one embodiment of the present invention as a weighting function when summing the individual windows of FIG. 19 to obtain the modified magnitude response shown in FIG. 22.

The windowed regions of the magnitude spectrum are then scaled by a short term gain factor so that the arithmetic mean of the windowed magnitude data set generally matches the arithmetic mean of the entire magnitude spectrum. One embodiment uses a short term gain factor 2000 as shown in FIG. 20. The individual windows are then added back together using a weighting function $W_i$, which results in a modified magnitude spectrum that generally approaches unity across all FFT bins. This process generally whitens the spectrum by maximizing spectral flatness. One embodiment of the present invention utilizes a Hann window for the weighting function as shown in FIG. 21.

Finally, for each j, 1<j<2M/D+1 where M=filter length the following expression is evaluated $$\left|S^{\omega}_{i-\frac{jD}{2}}\right| += \sum_{i=0}^{D-1}\frac{\left|S_{i-\frac{jD}{2}}\right|}{S'_j}\omega_i S'$$

Figure 22:
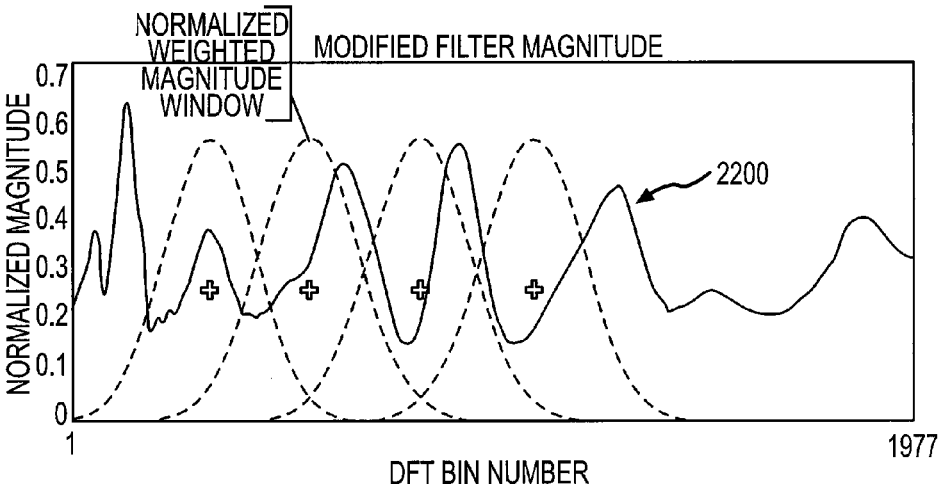
FIG. 22 depicts the final magnitude spectrum of a modified HRTF filter having improved spectral flatness.

FIG. 22 depicts the final magnitude spectrum 2200 of the modified HRTF filters having improved spectral balance.

The above whitening of the HRTF filters may generally be performed during operation 1030 of FIG. 10 by a preferred embodiment of the present invention.

Additionally, some effects of the binaural filters may cancel out when a stereo track is played back through two virtual speakers positioned symmetrically with respect to the listener's position. This may be due to the symmetry of both the inter-aural level difference ("ILD"), the ITD and the phase response of the filters. That is, the ILD, ITD and phase response of left ear filter and the right ear filter are generally reciprocals of one another.

Figure 23:
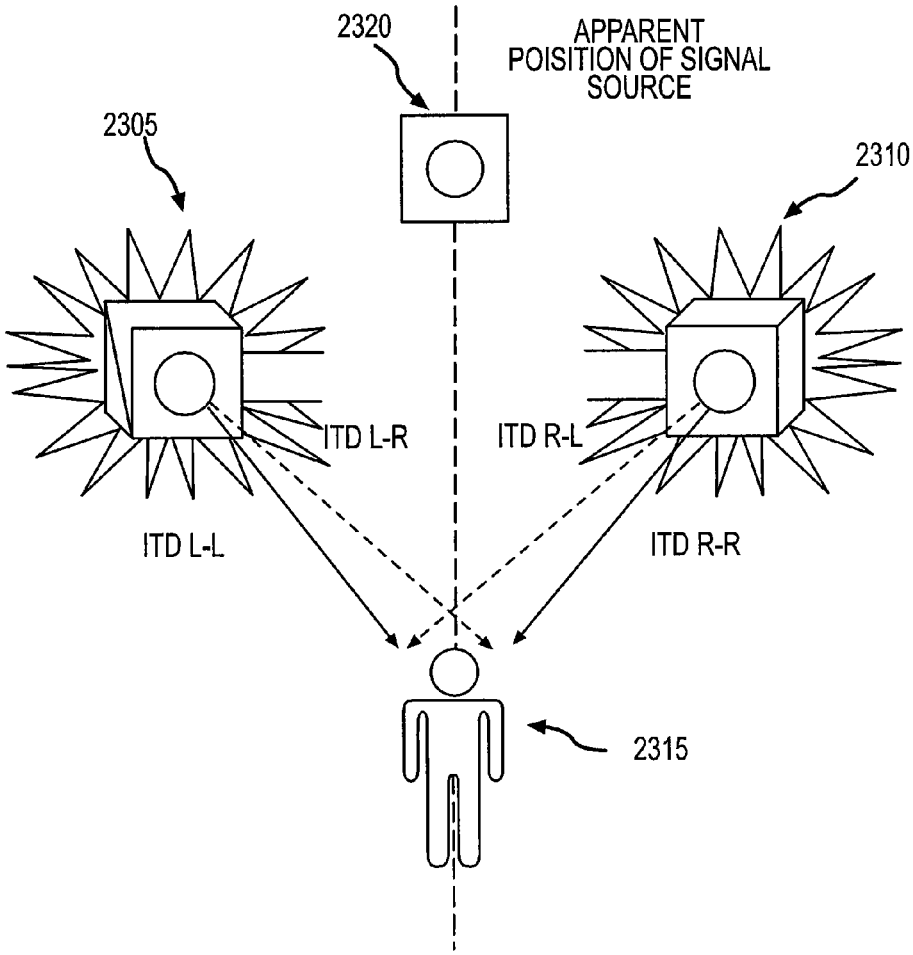
FIG. 23 illustrates the apparent position of a sound source when the left and right channels of a stereo signal are substantially identical.

FIG. 23 depicts a situation that may arise when the left and right channels of a stereo signal are substantially identical such as when a monaural signal is played through two virtual speakers 2305, 2310. Because the setup is symmetric with respect to the listener 2315, $$ITD\ L\text{-}R = ITD\ R\text{-}L \text{ and } ITD\ L\text{-}L = ITD\ R\text{-}R$$

where ITD L-R is the ITD for the left channel to the right ear, ITD R-L is the ITD for the right channel to the left ear, ITD L-L is the ITD for the left channel to the left ear and ITD R-R is the ITD for the right channel to the right ear.

For a monaural signal played back over two symmetrically located virtual speakers 2305, 2310, as shown in FIG. 23, the ITDs generally sum up so that the virtual sound source appears to come from the center 2320.

Figure 24:
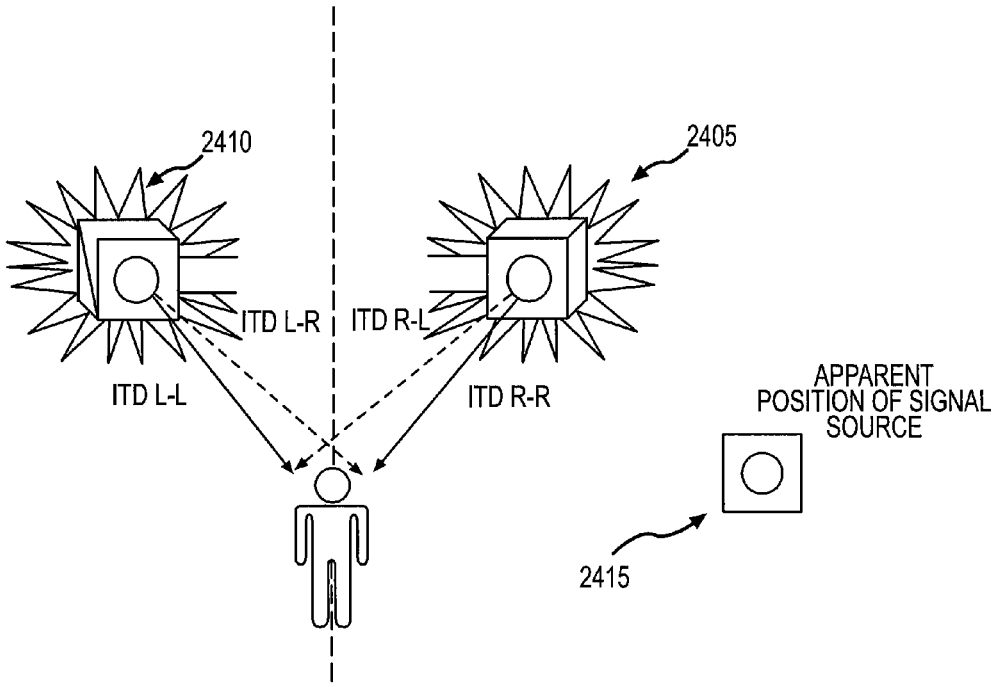
FIG. 24 illustrates the apparent position of a sound source when a signal appears only on the right channel.

Further, FIG. 24 shows a situation where a signal appears only on the right 2405 (or left 2410) channel. In such a situation, only the right (left) filter set and its ITD, ILD and phase and magnitude response will be applied to the signal, making the signal appear to come from a far right 2415 (far left) position outside the speaker field.

Figure 25:
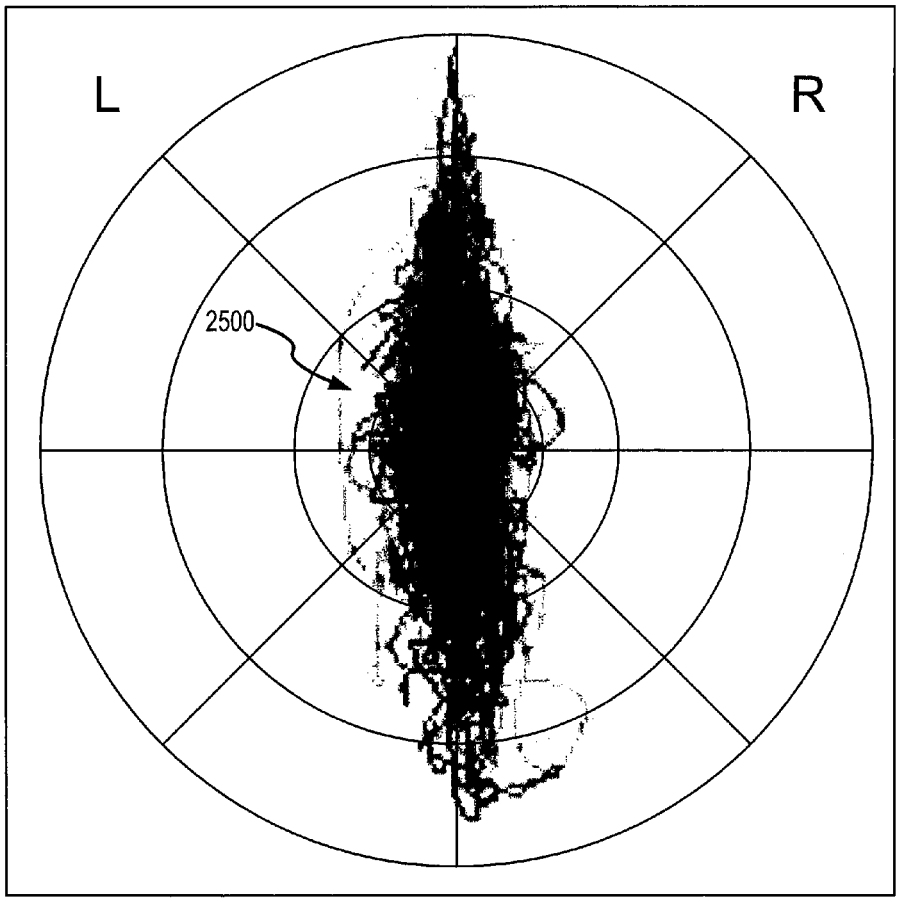
FIG. 25 depicts the Goniometer output of a typical stereo music signal showing the short term distribution of samples between the left and right channels.

Finally, when a stereo track is being processed, most of the energy will generally be located at the center of the stereo field 2500 as shown by FIG. 25. This generally means that for a stereo track with many instruments, most of the instruments will be panned to the center of the stereo image and only a few of the instruments will appear to be at the sides of the stereo image.

To make the localization more effective for a localized stereo signal played through two or more speakers, the sample distribution between the two stereo channels may be biased towards the edges of the stereo image. This effectively reduces all signals that are common to both channels by decorrelating the two input channels so that more of the input signal is localized by the binaural filters.

However, attenuating the center portion of the stereo image can introduce other issues. In particular, it may cause voice and lead instruments to be attenuated, creating an undesirable Karaoke-like effect. Some embodiments of the present invention may counteract this by band pass filtering a center signal to leave the voice and lead instruments virtually intact.

Figure 26:
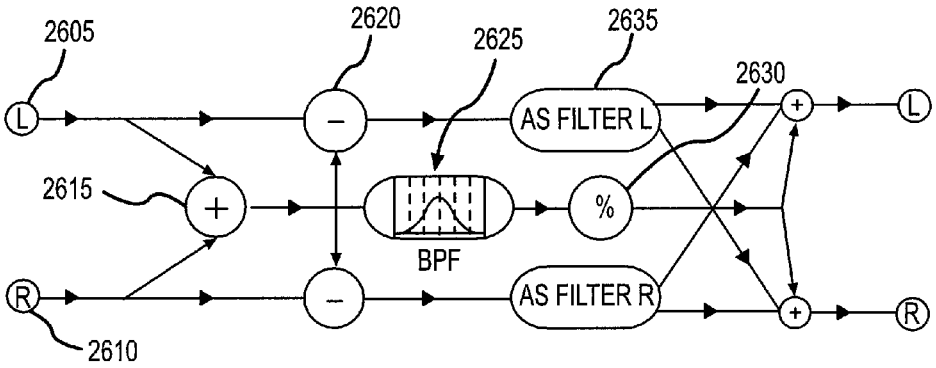
FIG. 26 depicts a signal routing for one embodiment of the present invention utilizing center signal band pass filtering.

FIG. 26 shows the signal routing for one embodiment of the present invention utilizing center signal band pass filtering. This may be incorporated into operation 525 of FIG. 5 by the embodiment.

Referring back to FIG. 5, the DSP processing mode may accept multiple input files or data streams to create multiple instances of DSP signal paths. The DSP processing mode for each signal path generally accepts a single stereo file or data stream as input, splits the input signal into its left and right channels, creates two instances of the DSP process, and assigns to one instance the left channel as a monaural signal and to the other instance the right channel as a monaural signal. FIG. 26 depicts the left instance 2605 and right instance 2610 within the processing mode.

The left instance 2605 of FIG. 26 contains all of the components depicted, but only has a signal present on the left channel. The right instance 2610 is similar to the left instance but only has a signal present on the right channel. In the case of the left instance, the signal is split with half going to the adder 2615 and half going to the left subtractor 2620. The adder 2615 produces a monaural signal of the center contribution of the stereo signal which is input to the band-pass filter 2625 where certain frequency ranges are allowed to pass through to the attenuator 2630. The center contribution may be combined with the left subtractor to produce only the left-most or left-only aspects of the stereo signal which are then processed by the left HRTF filter 2635 for localization. Finally the left localized signal is combined with the attenuated center contribution signal. Similar processing occurs for the right instance 2610.

The left and right instances may be combined into the final output. This may result in greater localization of the far left and far right sounds while retaining the presence the center contribution of the original signal.

In one embodiment, the band pass filter 2625 has a steepness of 12 dB/octave, a lower frequency cutoff of 300 Hz and an upper frequency cutoff of 2 kHz. Good results are generally produced when the percentage attenuation is between 20-40 percent. Other embodiments may use different settings for the band pass filter and/or different attenuation percentage.

7. Block Based Processing

In general, the audio input signal may be very long. Such a long input signal may be convolved with a binaural filter in the time domain to generate the localized stereo output. However, when a signal is processed digitally by some embodiments of the present invention, the input audio signal may be processed in blocks of audio data. Various embodiments may process blocks of audio data using a Short-Time Fourier transform ("STFT"). The STFT is a Fourier-related transform used to determine the sinusoidal frequency and phase content of local sections of a signal as it changes over time. That is, the STFT may be used to analyze and synthesize adjacent snippets of the time domain sequence of input audio data, thereby providing a short-term spectrum representation of the input audio signal.

Figure 27:
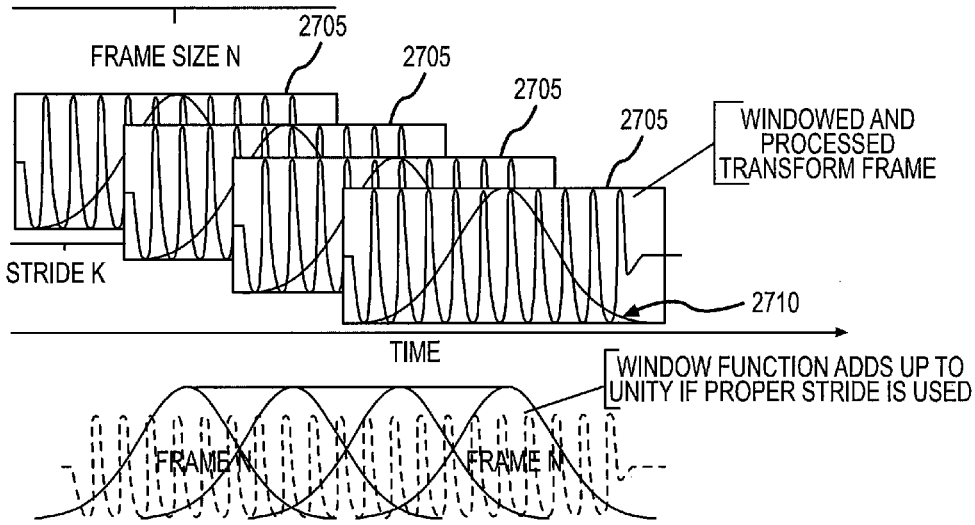
FIG. 27 illustrates how a long input signal is block processed using overlapping STFT frames.

Because the STFT operates on discrete chunks of data called "transform frames," the audio data may be processed in blocks 2705 such that the blocks overlap as shown in FIG. 27. STFT transform frames are taken every k samples (called a stride of k samples), where k is an integer smaller than the transform frame size N. This results in adjacent transform frames overlapping by the stride factor defined as (N−k)/N. Some embodiments may vary the stride factor.

The audio signal may be processed in overlapping blocks to minimize edge effects that result when a signal is cut off at the edges of the transform window. The STFT sees the signal inside the transform frame as being periodically extended outside the frame. Arbitrarily cutting off the signal may introduce high frequency transients that may cause signal distortion. Various embodiments may apply a window 2710 (tapering function) to the data inside the transform frame causing the data to gradually go to zero at the beginning and end of the transform frame. One embodiment may use a Hann window as a tapering function.

The Hann window function is expressed mathematically as $$y=0.5-0.5\cos(\mathbf{2}7\pi t/N).$$

Other embodiments may employ other suitable windows such as, but not limited to, Hamming, Gauss and Kaiser windows.

In order to create a seamless output from the individual transform frames, an inverse STFT may be applied to each transform frame. The results from the processed transform frames are added together using the same stride as used during the analysis phase. This may be done using a technique called "overlap-save" where part of each transform frame is stored to apply a cross-fade with the next frame. When a proper stride is used, the effect of the windowing function cancels out (i.e., sums up to unity) when the individual filtered transform frames are strung together. This produces a glitch-free output from the individually filtered transform frames. In one embodiment, a stride equal to 50% of the FFT transform frame size may be used, i.e., for a FFT frame size of 4096, the stride may be set to 2048. In this embodiment, each processed segment overlaps the previous segment by 50%. That is, the second half of STFT frame i may be added to the first half of STFT frame i+1 to create the final output signal. This generally results in a small amount of data being stored during signal processing to achieve the cross-fade between frames.

Generally, because a small amount of data may be stored to achieve the cross-fade, a slight latency (delay) between the input and output signals may occur. Because this delay is typically well below 20 ms and is generally the same for all processed channels, it generally has negligible effect on the processed signals. It should also be noted that data may be processed from a file, rather than being processed live, making such delay irrelevant.

Furthermore, block based processing may limit the number of parameter updates per second. In one embodiment of the present invention, each transform frame may be processed using a single set of HRTF filters. As such, no change in sound source position over the duration of the STFT frame occurs. This is generally not noticeable because the cross-fade between adjacent transform frames also smoothly cross-fades between the renderings of two different sound source positions. Alternatively, the stride k may be reduced but this typically increases the number of transform frames processed per second.

For optimum performance, the STFT frame size may be a power of 2. The size of the STFT may be dependent upon several factors including the sample rate of the audio signal. For an audio signal sampled at 44.1 kHz, the STFT frame size may be set at 4096 in one embodiment of the present invention. This accommodates the 2048 input audio data samples and the 1920 filter coefficients which when convolved in the Frequency domain result in an output sequence length of 3967 samples. For input audio data sample rates higher or lower than 44.1 kHz, the STFT frame size, input sample size and number of filter coefficients may be proportionately adjusted higher or lower.

In one embodiment an audio file unit may provide the input to the signal processing system. The audio file unit reads and converts (decodes) audio files to a stream of binary pulse code modulated ("PCM") data that vary proportionately with the pressure levels of the original sound. The final input data stream may be in IEEE754 floating point data format (i.e., sampled at 44.1 kHz and data values restricted to the range −1.0 to +1.0). This enables consistent precision across the whole processing chain. It should be noted that the audio files being processed are generally sampled at a constant rate. Other embodiments may utilize audio files encoded in other formats and/or sampled at different rates. Yet, other embodiments may process the input audio stream of data from a plug-in card such as a sound card in substantially real-time.

As discussed previously, one embodiment may utilize a HRTF filter set having 7,337 pre-defined filters. These filters may have coefficients that are 24 bits in length. The HRTF filter set may be changed into a new set of filters (i.e., the coefficients of the filters) by up-sampling, down-sampling, up-resolving or down-resolving to change the original 44.1 kHz, 24 bit format to any sample rate and/or resolution that may then be applied to an input audio waveform having a different sample rate and resolution (e.g., 88.2 kHz, 32 bit).

After processing of the audio data, the user may save the output to a file. The user may save the output as a single, internally mixed down stereo file, or may save each localized track as individual stereo files. The user may also choose the resulting file format (e.g., *.mp3, *.aif, *.au, *.wav, *.wma, etc.). The resulting localized stereo output may be played on conventional audio devices without any specialized equipment required to reproduce the localized stereo sound. Further, once stored, the file may be converted to standard CD audio for playback through a CD player. One example of a CD audio file format is the .CDA format. The file may also be converted to other formats including, but not limited to, DVD-Audio, HD Audio and VHS audio formats.

Localized stereo sound, which provides directional audio cues, can be applied in many different applications to provide the listener with a greater sense of realism. For example, the localized 2 channel stereo sound output may be channeled to a multi-speaker set-up such as 5.1. This may be done by importing the localized stereo file into a mixing tool such as DigiDesign's ProTools to generate a final 5.1 output file. Such a technique would find application in high definition radio, home, auto, commercial receiver systems and portable music systems by providing a realistic perception of multiple sound sources moving in 3D space over time. The output may also be broadcast to TVs, used to enhance DVD sound or used to enhance movie sound.

The technology may also be used to enhance the realism and overall experience of virtual reality environments of video games. Virtual projections combined with exercise equipment such as treadmills and stationary bicycles may also be enhanced to provide a more pleasurable workout experience. Simulators such as aircraft, car and boat simulators may be made more realistic by incorporating virtual directional sound.

Stereo sound sources may be made to sound much more expansive, thereby providing a more pleasant listening experience. Such stereo sound sources may include home and commercial stereo receivers as well as portable music players.

The technology may also be incorporated into digital hearing aids so that individuals with partial hearing loss in one ear may experience sound localization from the non-hearing side of the body. Individuals with total loss of hearing in one ear may also have this experience, provided that the hearing loss is not congenital.

The technology may be incorporated into cellular phones, "smart" phones and other wireless communication devices that support multiple, simultaneous (i.e., conference) calls, such that in real-time each caller may be placed in a distinct virtual spatial location. That is, the technology may be applied to voice over IP and plain old telephone service as well as to mobile cellular service.

Additionally, the technology may enable military and civilian navigation systems to provide more accurate directional cues to users. Such enhancement may aid pilots using collision avoidance systems, military pilots engaged in air-to-air combat situations and users of GPS navigation systems by providing better directional audio cues that enable the user to more easily identify the sound location.

As will be recognized by those skilled in the art from the foregoing description of example embodiments of the invention, numerous variations of the described embodiments may be made without departing from the spirit and scope of the invention. For example, more or fewer HRTF filter sets may be stored, the HRTF may be approximated using other types of impulse response filters such as IIR filters, a different STFT frame size and stride length may be used, and the filter coefficients may be stored differently (such as entries in a SQL database). Further, while the present invention has been described in the context of specific embodiments and processes, such descriptions are by way of example and not limitation. Accordingly, the proper scope of the present invention is specified by the following claims and not by the preceding examples.

We claim:

1. A computer-implemented method for simulating a binaural filter for a spatial point, the method comprising:

in a signal processing system including a processor, accessing a plurality of pre-defined binaural filters, wherein each binaural filter further comprises a left ear head related transfer function filter and a right ear head related transfer function filter;

selecting at least two nearest neighbor binaural filters from the plurality of predefined binaural filters; and performing an interpolation among the nearest neighbor binaural filters to obtain a new binaural filter, wherein the operation of performing an interpolation among the nearest neighbor binaural filters further comprises:

determining an inter-aural time difference for each nearest neighbor head related transfer function filter;

removing the inter-aural time difference of each nearest neighbor head related transfer function filter prior to the interpolation;

interpolating the inter-aural time differences of the nearest neighbor binaural filters to obtain a new inter-aural time difference; and including the new inter-aural time difference in the new binaural filter.

2. A method according to claim 1, wherein each pre-defined binaural filter is located on a unit sphere.

3. A method according to claim 2, wherein the nearest neighbor binaural filter is spatially closer to the spatial point than the other pre-defined binaural filters.

4. The method of claim 2, wherein the pre-defined binaural filters are uniformly spaced around the unit circle.

5. The method of claim 2, wherein the unit sphere is scaled from 0 to 100 units and wherein 0 represents a center of a virtual room and 100 represents a periphery of the virtual room.

6. A method according to claim 3, wherein the selection of each nearest neighbor binaural filter is based, at least in part, on a distance between the nearest neighbor binaural filter and the spatial point.

7. A method according to claim 6, wherein the distance is a minimum Pythagorean distance.

8. A method according to claim 1, wherein the left head related transfer function filter is a left head related transfer function approximated by an impulse response filter having a first plurality of coefficients and the right head related transfer function filter is a right head related transfer function approximated by an impulse response filter having a second plurality of coefficients.

9. A method according to claim 1, wherein the inter-aural time difference comprises a left inter-aural time difference and a right inter-aural time difference.

10. A method according to claim 1, further comprising accounting for the spatial point position when determining the inter-aural time difference.

11. The method of claim 1, wherein the interpolation is selected from a set consisting of sync interpolation, linear interpolation, and parabolic interpolation.

12. The method of claim 1, wherein the plurality of pre-defined binaural filters comprises 7,337 pre-defined binaural filters, each binaural filter at a discrete location on a unit sphere.

13. The method of claim 1, further comprising:

calculating a discrete Fourier transform of the new binaural filter;

setting the frequency response to a fixed amplitude when the frequency is less than a lower cutoff frequency or greater than an upper cutoff frequency; and setting the phase response to a fixed phase when the frequency is less than the lower cutoff frequency or greater than the upper cutoff frequency.

* * * * *